US009581405B2

(12) United States Patent
Saunders

(10) Patent No.: US 9,581,405 B2
(45) Date of Patent: Feb. 28, 2017

(54) SLINGSHOT WITH HANDLE GUARD AND PALM PLATE

(71) Applicant: Charles A. Saunders, Columbus, NE (US)

(72) Inventor: Charles A. Saunders, Columbus, NE (US)

(73) Assignee: SAUNDERS ARCHERY COMPANY, Columbus, NE (US)

( * ) Notice: Subject to any disclaimer, the term of this patent is extended or adjusted under 35 U.S.C. 154(b) by 0 days.

(21) Appl. No.: 14/216,108

(22) Filed: Mar. 17, 2014

(65) Prior Publication Data

US 2014/0261353 A1 Sep. 18, 2014

Related U.S. Application Data

(60) Provisional application No. 61/787,885, filed on Mar. 15, 2013.

(51) Int. Cl.
*F41B 3/02* (2006.01)

(52) U.S. Cl.
CPC ..... *F41B 3/02* (2013.01)

(58) Field of Classification Search
CPC .... F41B 7/025; F41B 3/02; F41B 3/00; F41B 5/0031; F41B 3/03; F41B 3/04; F41B 9/0062; F41B 3/005
USPC ..... 124/20.1, 20.2, 20.3, 29, 89; 446/266, 446/421; 473/203, 538, 549; 74/543, 74/551.7, 156, 511 R, 557, 145
See application file for complete search history.

(56) References Cited

U.S. PATENT DOCUMENTS

| | | | | |
|---|---|---|---|---|
| 4,265,212 | A * | 5/1981 | Wolf | 124/20.1 |
| 5,230,323 | A | 7/1993 | Saunders et al. | |
| 5,657,738 | A * | 8/1997 | Klundt | 124/17 |
| 5,853,000 | A * | 12/1998 | Torgerson et al. | 124/88 |
| 8,347,868 | B2 | 1/2013 | Saunders | |
| 8,640,682 | B2 * | 2/2014 | Shirk, II | 124/20.1 |
| 2006/0191521 | A1 * | 8/2006 | Gee | 124/20.1 |
| 2008/0053421 | A1 * | 3/2008 | Chang | 124/45 |
| 2008/0156308 | A1 * | 7/2008 | Zadra | 124/20.1 |
| 2010/0154583 | A1 * | 6/2010 | Chuang | 74/551.7 |
| 2012/0125266 | A1 * | 5/2012 | Ying | 119/707 |
| 2013/0247894 | A1 * | 9/2013 | Saunders | 124/80 |

* cited by examiner

*Primary Examiner* — Gene Kim
*Assistant Examiner* — Rayshun Peng
(74) *Attorney, Agent, or Firm* — Levenfeld Pearlstein, LLC

(57) ABSTRACT

A slingshot with handle guard and palm plate is disclosed. The slingshot includes a handle, a pair of forward facing arms with band attachment devices, an arm brace and a retaining clip for securing the arm brace to the handle. The handle includes a plurality of grooves adapted to receive a palm plate at various locations along the length of the handle. The handle further includes a groove formed therein for engaging one end of a handle guard as well as a recess for receiving the other end of the handle guard, which is secured by the retaining clip. The handle further includes a bore formed therethrough for accessories, such as stabilizers, dampeners, storage containers and the like.

16 Claims, 49 Drawing Sheets

SLINGSHOT WITH HANDLE GUARD AND PALM PLATE

CROSS REFERENCE TO RELATED APPLICATIONS

This application claims benefit of U.S. Provisional Patent Application Ser. No. 61/787,885, filed on Mar. 15, 2013, the disclosure of which is incorporated herein by reference.

BACKGROUND OF THE INVENTION

The present invention relates generally to slingshots and, more particularly, to a slingshot with handle guard and palm plate.

Slingshots commonly are used for recreation and for hunting. Although slingshots have existed for centuries, the basic design and mechanics have remained constant over time. Quite simply, a traditional slingshot comprises a handle and a pair of arms extending divergently upward from the handle. An elastic band is attached between the arms. Typically, centered on the elastic band is a pouch designed to hold a projectile.

After a projectile is placed in the pouch, the pouch is pulled backwards, away from the arms, thereby extending and stretching the elastic band to create potential energy. When the pouch is released, the potential energy of the elastic band is transformed to kinetic energy which is transferred to the projectile through the pouch. The projectile then is thrust forward, out of the pouch, and away from slingshot shooter and toward a desired target.

Various design enhancements have been made over the years in an attempt to improve the functionality and performance of slingshots. For example, such improved slingshot devices include arm and wrist braces to help stabilize shots, foldable designs to make devices more portable, aiming mechanisms to improve accuracy, multi-band designs to improve band life and increase shot speed and pulley assemblies to produce maximum projectile velocity with minimum force exertion by the user.

One such improved slingshot design is disclosed in U.S. Pat. No. 5,230,323 to Saunders et al., the disclosure of which is fully incorporated herein by reference. Saunders discloses an arm-braced slingshot having a handle, a hook assembly, a pair of elastic bands, a pouch, an arm brace and a retaining clip. The arm brace comprises a generally U-shaped collar having an intermediate yoke portion which is dimensioned to be received in a peripheral recess of the handle. The distal ends of the collar are provided with an arm strap extending therebetween which extends over the user's forearm when the handle is gripped in the normal manner during use of the slingshot.

The slingshot disclosed in Saunders has been updated and improved over time with respect to the types of bands, pouches and connection mechanisms used with the slingshot. Modern variations of the Saunders slingshot design utilize flat bands, quick-snap band connection/replacement mechanisms and unique pouch designs, among other features. For example, U.S. Pat. No. 8,347,868 to Saunders, the disclosure of which is fully incorporated herein by reference, discloses a collapsible locking slingshot having a quick-release interchangeable band system that uses clips that matingly engage grooves formed at the ends of the slingshot arms.

Another known slingshot design combines features disclosed in U.S. Pat. No. 5,230,323 and U.S. Pat. No. 8,347,868. This prior art slingshot 100, depicted in FIG. 1, includes a handle 101, a pair of forward facing arms 102, a band 103, a pouch 104, an arm brace 105 and a retaining clip 106 for securing arm brace 105 and arms 102 to handle 101.

However, instead of using tubular bands and a hook assembly, the prior art device depicted in FIG. 1 uses a quick-release interchangeable band system having adapters 107 mounted to the ends of arms 102, the adapters 107 having grooves with which clips 108 are matingly engaged in order to secure the ends of band 103 to arms 102. Such a device is sold by Saunders Archery Company, in Columbus, Nebr. under the brand name "Falcon-2™."

Despite all of the innovations in slingshot technology, room still exists for improvement. In particular, slingshot handle designs can be improved to provide for additional functionality, improved usability, the addition of protective equipment and the addition of accessories. Such improvements would permit slingshots to become more usable, accurate and enjoyable.

What is needed, therefore, is a slingshot having an improved handle design. Preferably, such a slingshot comprises a handle adapted to receive a palm plate, the palm plate configured to engage a user's palm when the slingshot is shot and the palm plate being adjustably mountable to the handle to accommodate different sized hands. More preferably, such a slingshot comprises a handle adapted to receive a handle guard, the handle guard configured to prevent the band from contacting the handle (and the user's hand holding the handle) during recoil. More preferably yet, such a slingshot comprises a handle adapted to receive accessories, such as stabilizers, dampeners, storage containers and the like. The present invention satisfies this need.

BRIEF SUMMARY OF THE INVENTION

According to one aspect, there is provided a slingshot comprising a handle including a plurality of grooves and mounting posts, the grooves spaced along a length of the handle, a pair of forward facing arms extending upwardly and forwardly from the handle, each arm having a band attachment device, an arm brace secured to the handle, and a palm plate removably secured to the handle at one groove of the plurality of grooves and corresponding mounting posts. The palm plate is configured to be removed from the groove of the plurality of grooves and secured to another groove of the plurality of grooves and corresponding mounting posts to adjust a position of the palm plate along a length of the handle.

According to another aspect, there is provided handle for a slingshot. The handle includes a plurality of grooves and mounting posts, the grooves spaced along a length of the handle, a top having an elongated recess configured to receive a portion of a retaining clip, and a groove formed at a bottom of a forward face thereof.

According to still another aspect, there is provided a palm plate for a handle of a slingshot, the palm plate adjustable along a length of the handle of the slingshot to accommodate differently sized gripping areas. The palm plate includes body with a pair of arms extending therefrom, each arm including a collar, and a lip disposed between the arms. The collars are configured to matingly engage mounting posts of the handle and the lip is configured to engage grooves of the handle to secure the palm plate at a location along the length of the handle.

According to yet another aspect, there is provided a handle guard for attaching to a forward face of a handle of a slingshot. The handle guard includes a generally arcuate strap of material having a first end and a second end. The first end has a tongue configured to matingly engage a groove formed on a bottom of the forward face of the handle. The second end includes an aperture and a handle guard recess adjacent to the aperture, the second end configured to be received in an elongated recess at a top of the handle. The aperture is configured to receive a retaining clip therethrough and the handle guard recess is configured to receive a portion of the retaining clip.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
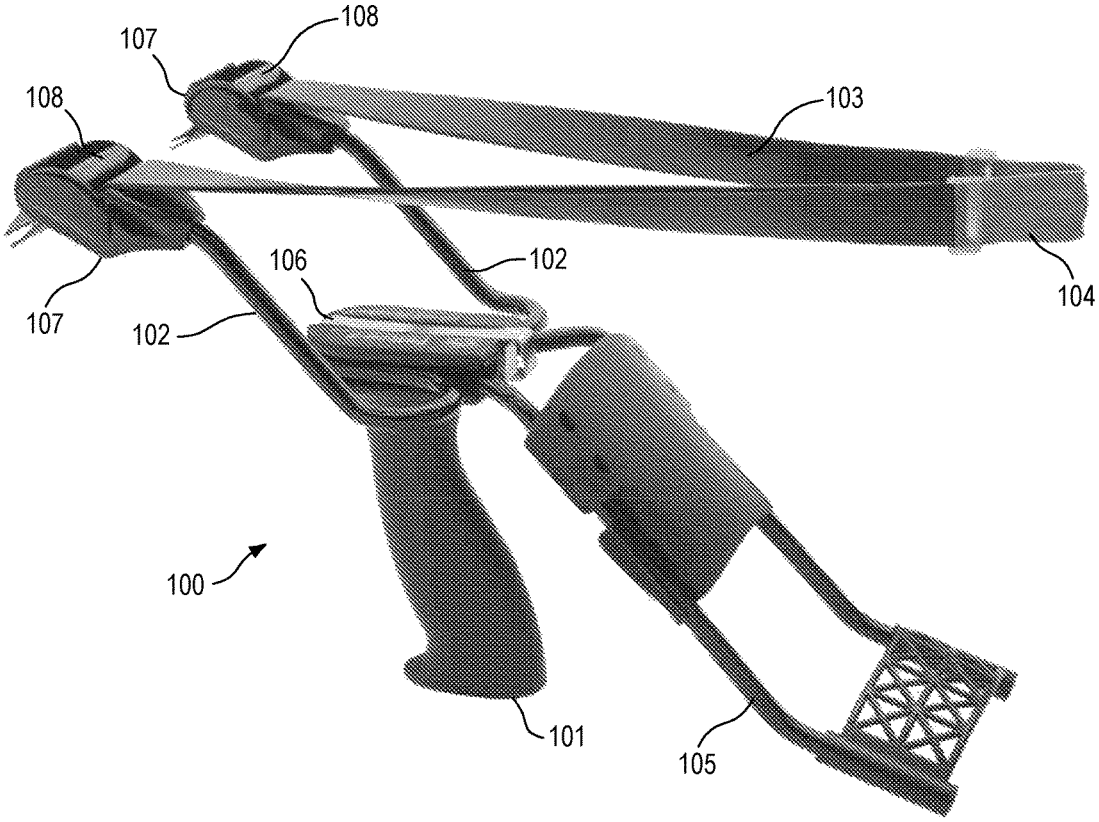
FIG. 1 (PRIOR ART)
FIG. 1 is a perspective view of a prior art slingshot.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

FIGS. 2-35 illustrate a slingshot with handle guard and palm plate, a handle, a palm plate and a handle guard embodying the principles of the claimed device.

As shown in FIGS. 2-35, slingshot 1 comprises a handle 2, a pair of arms 4 extending upwardly and forwardly from handle 2 with band attachment devices 5 attached to the ends of arms 4, an arm brace 6, and a retaining clip 3 for securing arm brace 6 and arms 4 to handle 2. An optional bail guard 13 is shown attached to arm brace 6 in the disclosed embodiment of slingshot 1. This basic configuration (excluding the design of handle 2) is known in the art.

Handle 2 of slingshot 1 is formed as a pistol grip handle member having a generally flat top 7. Top 7 of handle 2 is provided with an elongated recess 8 which is dimensioned at one end 9 to receive a portion of retaining clip 3 and dimensioned at the other end 10 to receive a portion of a handle guard 11. In this manner, retaining clip 3 secures one end of handle guard 1 to the top 7 of handle 2, as further discussed below. The top 7 may be formed on a mounting base 27. The handle 2 further includes a gripping portion 28 extending from the mounting base 27. The mounting base 27 includes a peripheral groove 29, extending at least partially about the periphery of the mounting base 27, in which the arms 4 and the arm brace 6 may be secured by the retaining clip.

Figure 2:
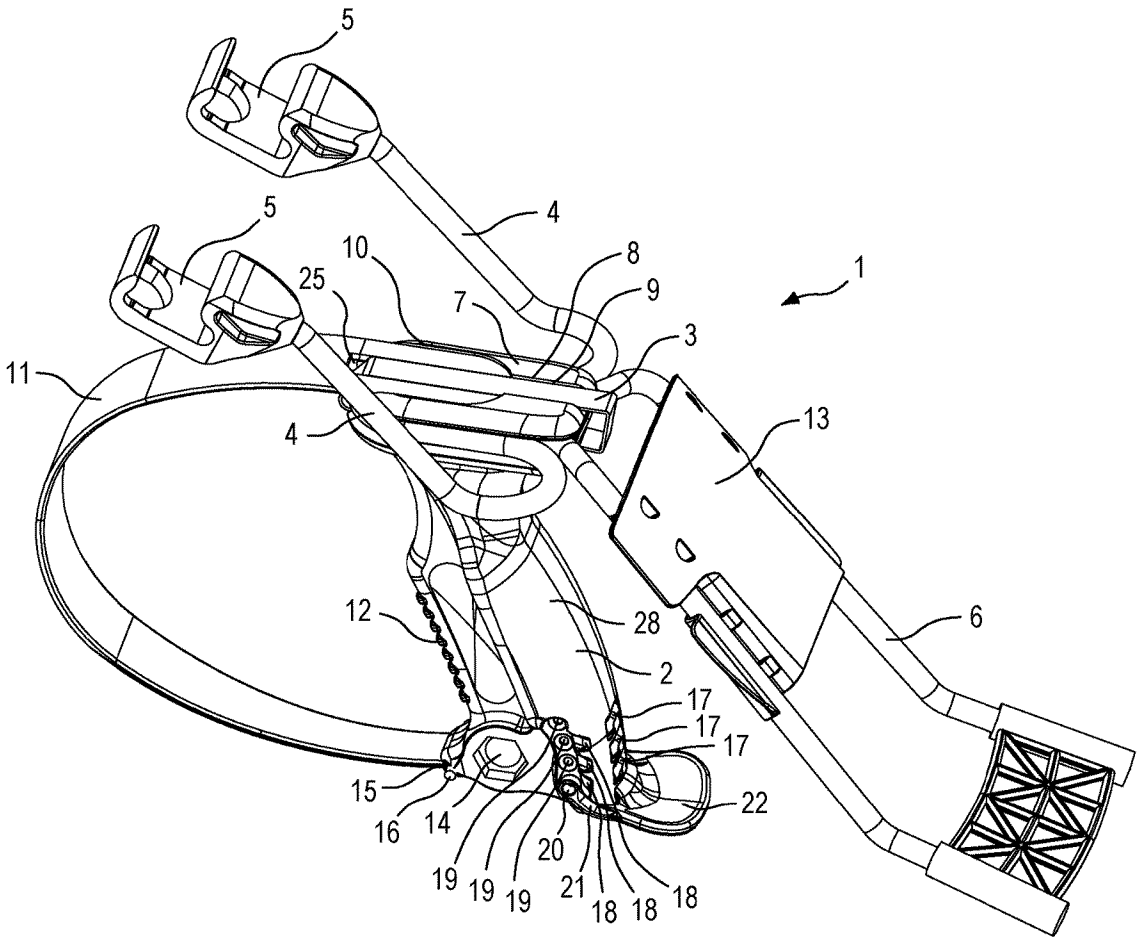
FIG. 2 is a perspective view of a slingshot with handle guard and palm plate according to one embodiment.
Figure 3:
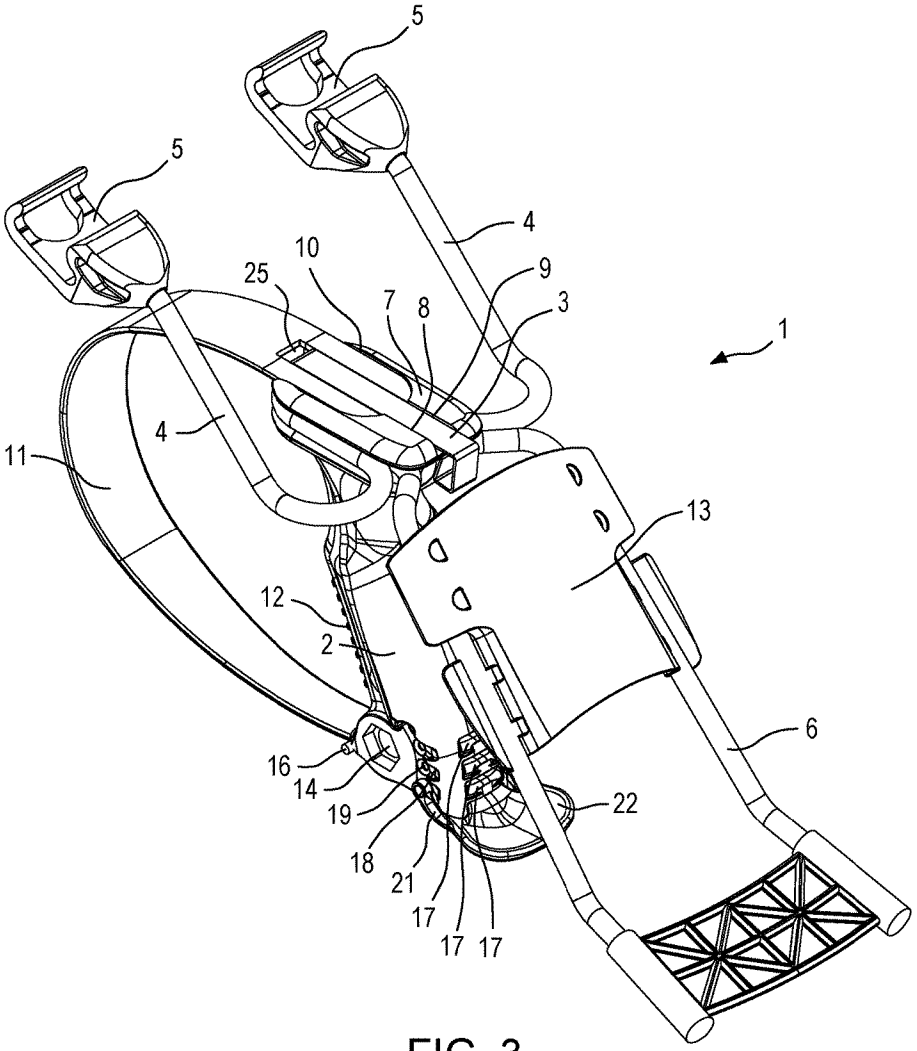
FIG. 3 is a perspective view of the slingshot of FIG. 2.
Figure 4:
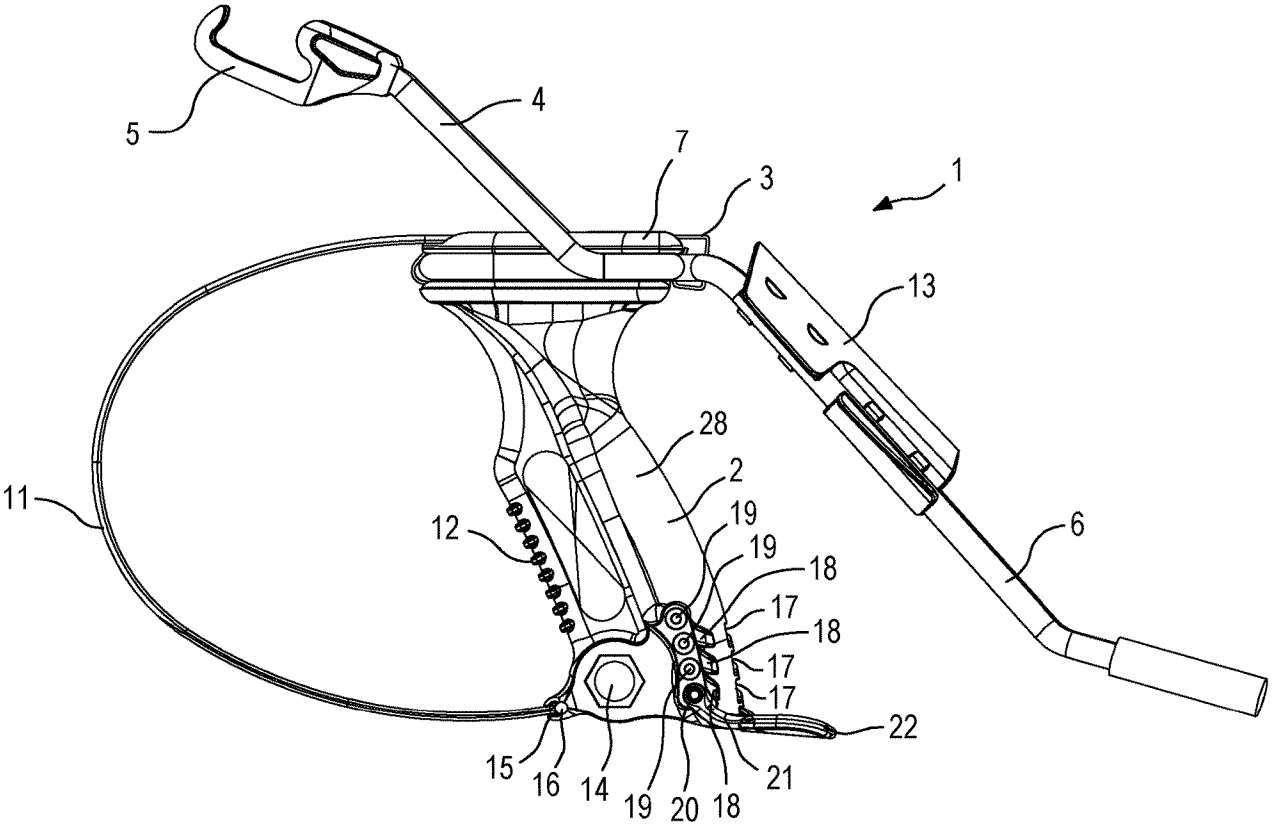
FIG. 4 is a right side view of the slingshot of FIG. 2.
Figure 5:
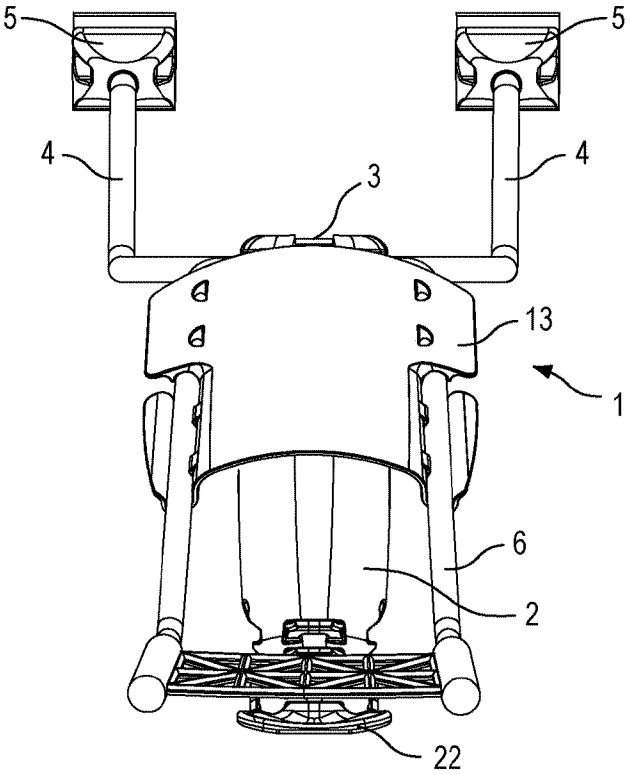
FIG. 5 is a rear view of the slingshot of FIG. 2.
Figure 6:
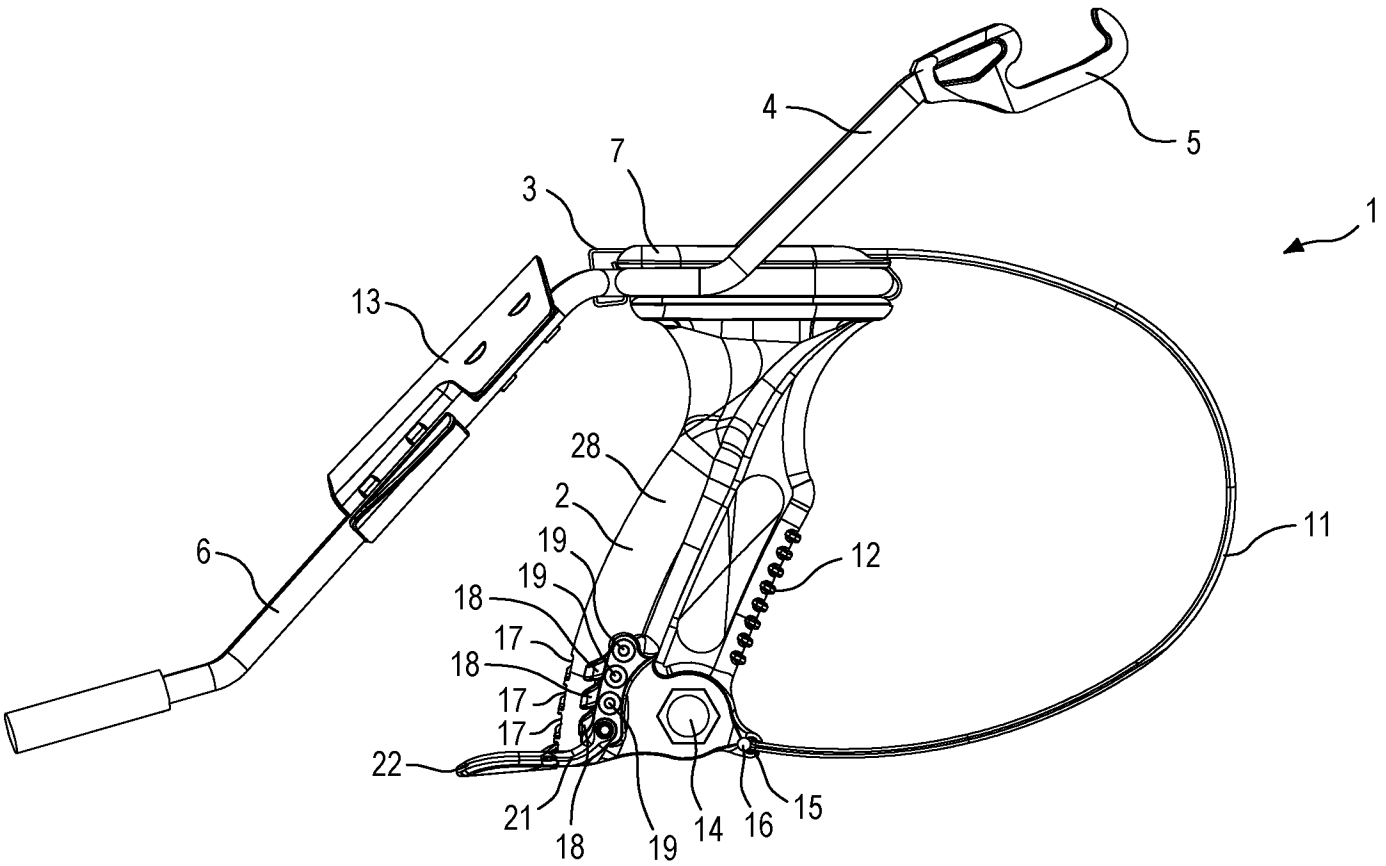
FIG. 6 is a left side view of the slingshot of FIG. 2.
Figure 7:
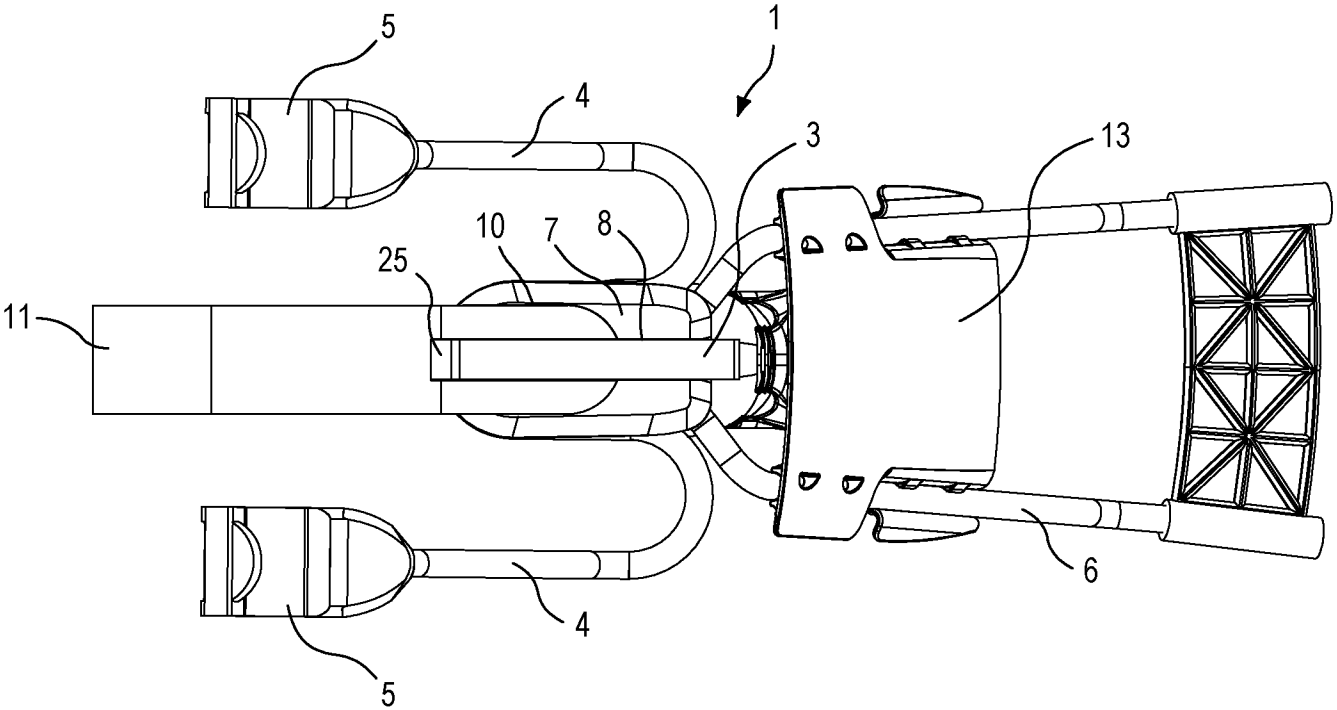
FIG. 7 is a top view of the slingshot of FIG. 2.
Figure 8:
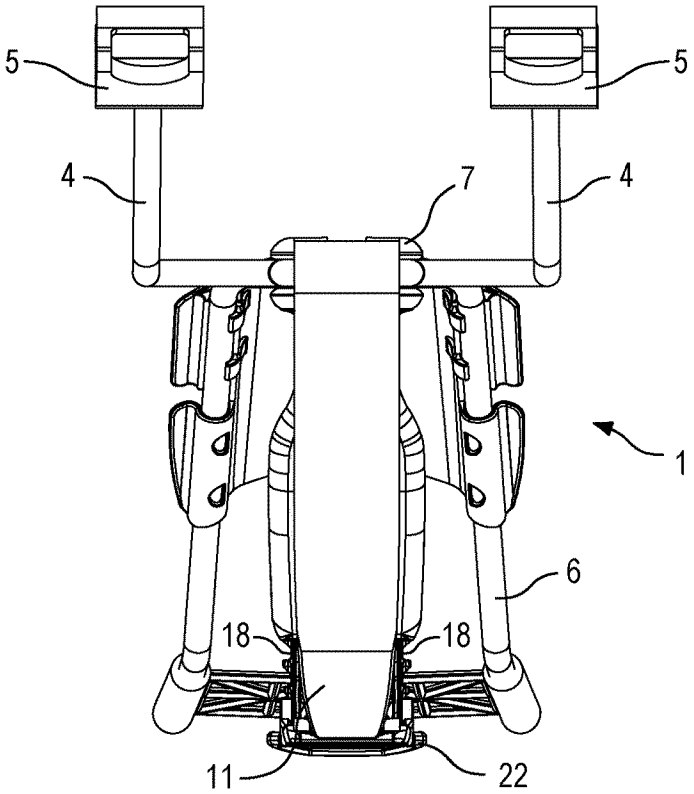
FIG. 8 is a front view of the slingshot of FIG. 2.
Figure 9:
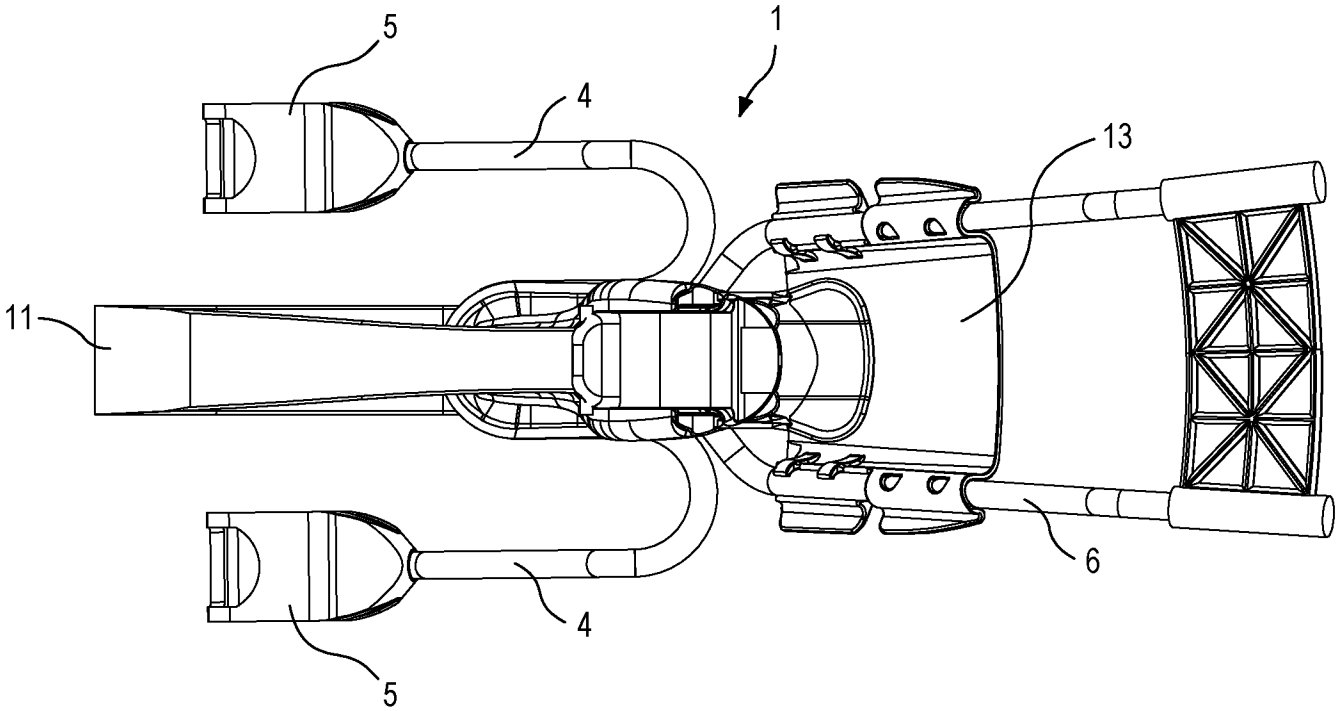
FIG. 9 is a bottom view of the slingshot of FIG. 2.
Figure 10:
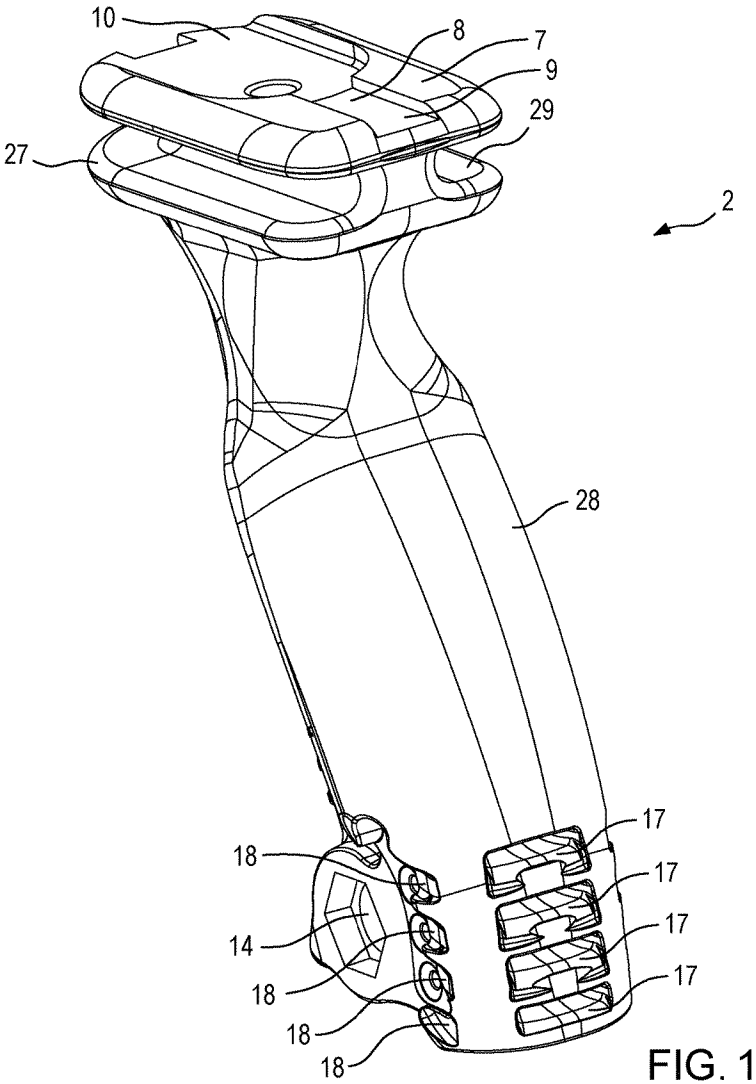
FIG. 10 is an enlarged perspective view of a handle of the slingshot according to one embodiment.
Figure 11:
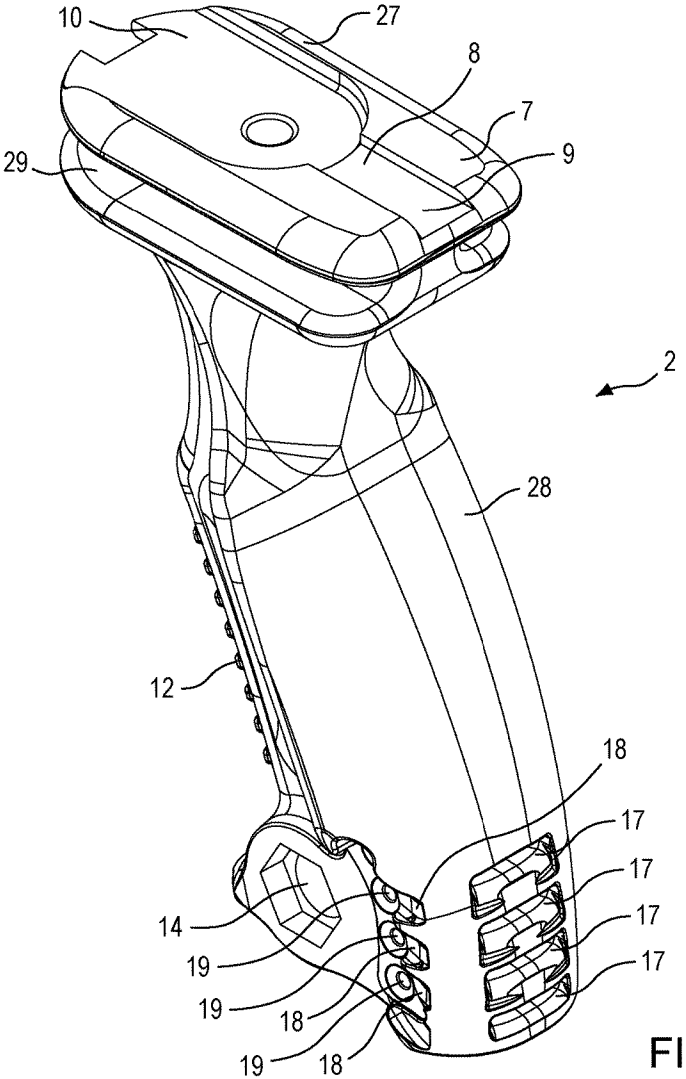
FIG. 11 is a perspective view of the handle of FIG. 10.
Figure 12:
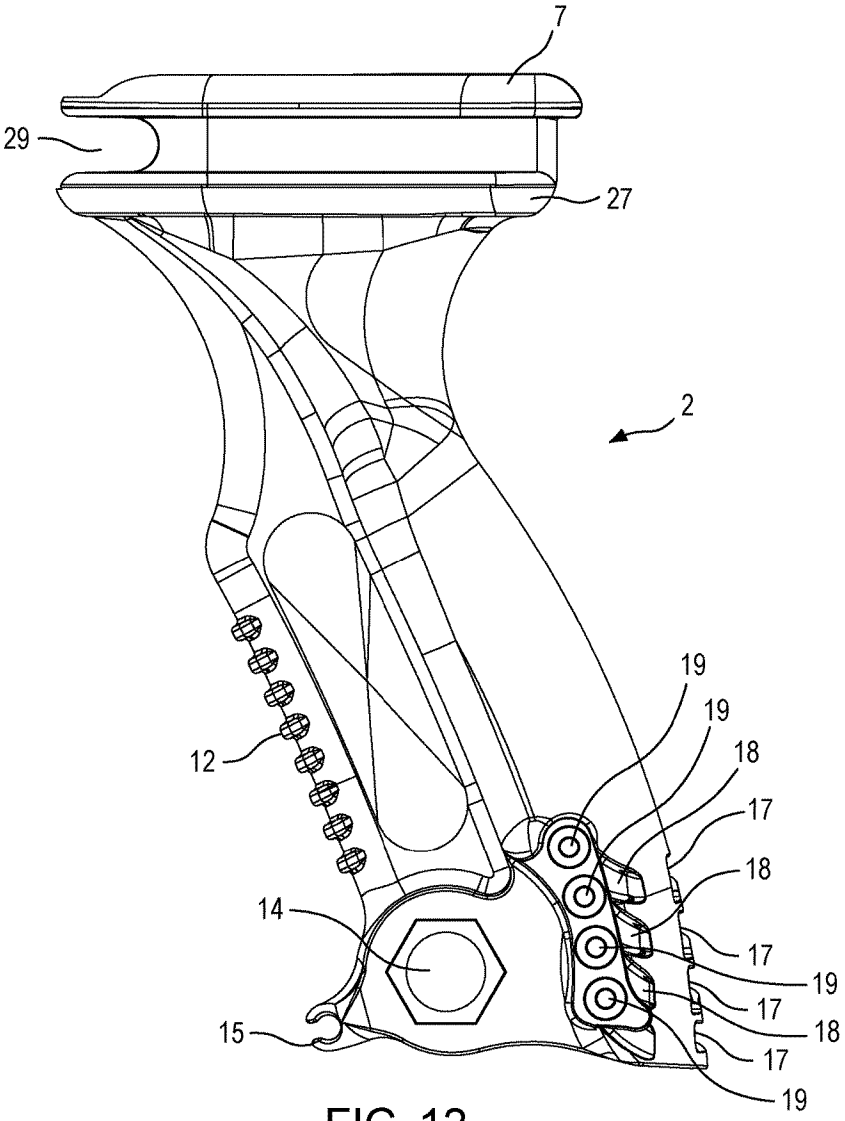
FIG. 12 is a right side view of the handle of FIG. 10.
Figure 13:
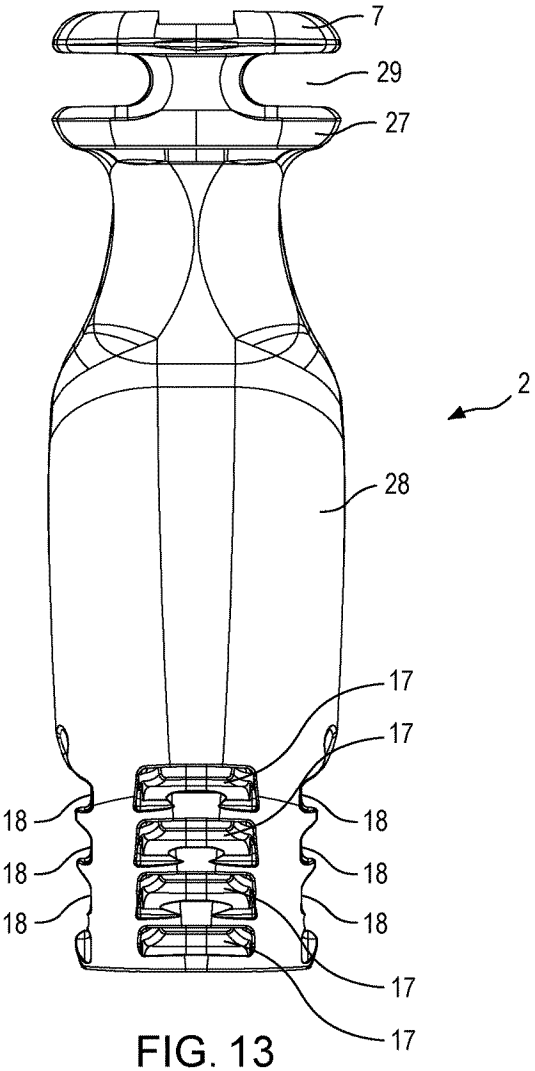
FIG. 13 is a rear view of the handle of FIG. 10.
Figure 14:
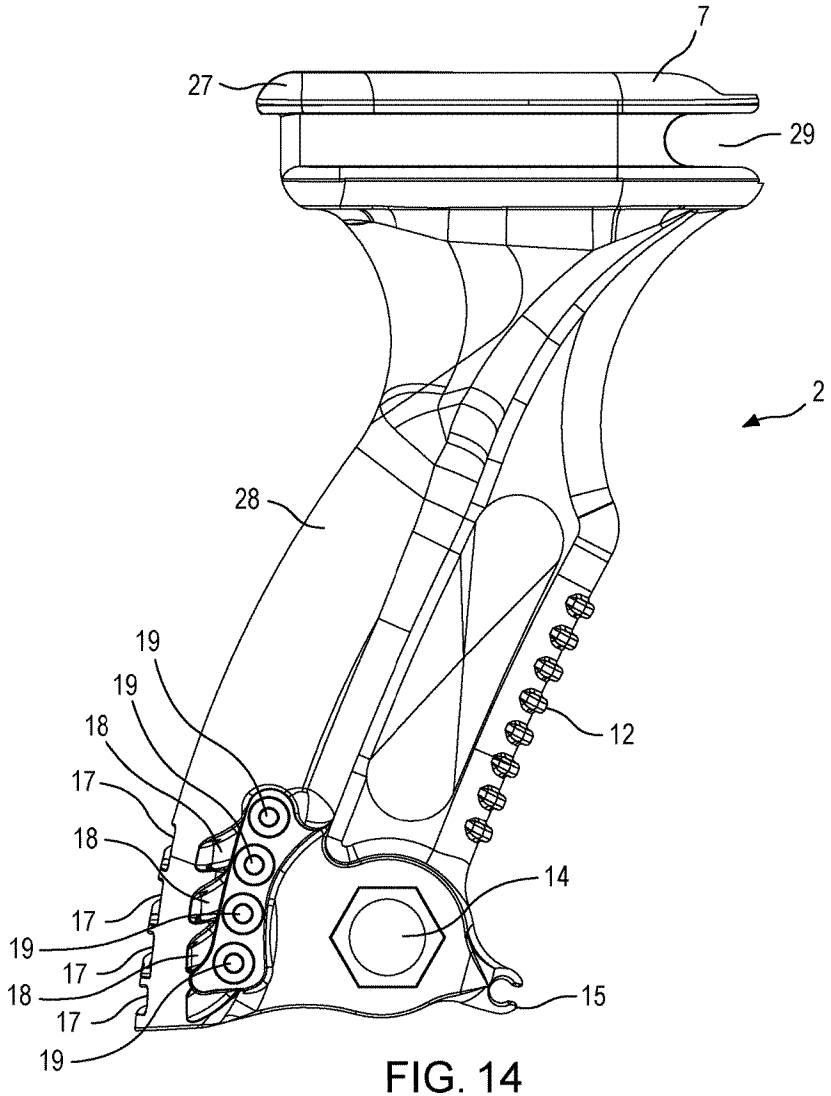
FIG. 14 is a left side view of the handle of FIG. 10.
Figure 15:
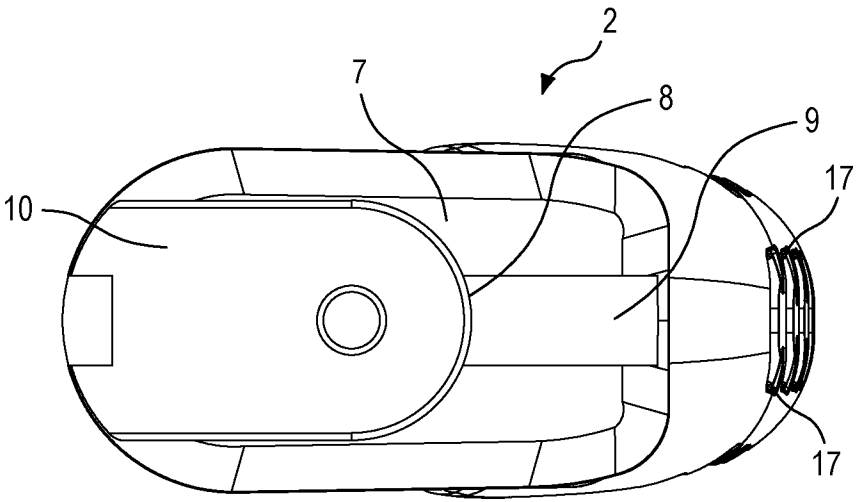
FIG. 15 is a top view of the handle of FIG. 10.
Figure 16:
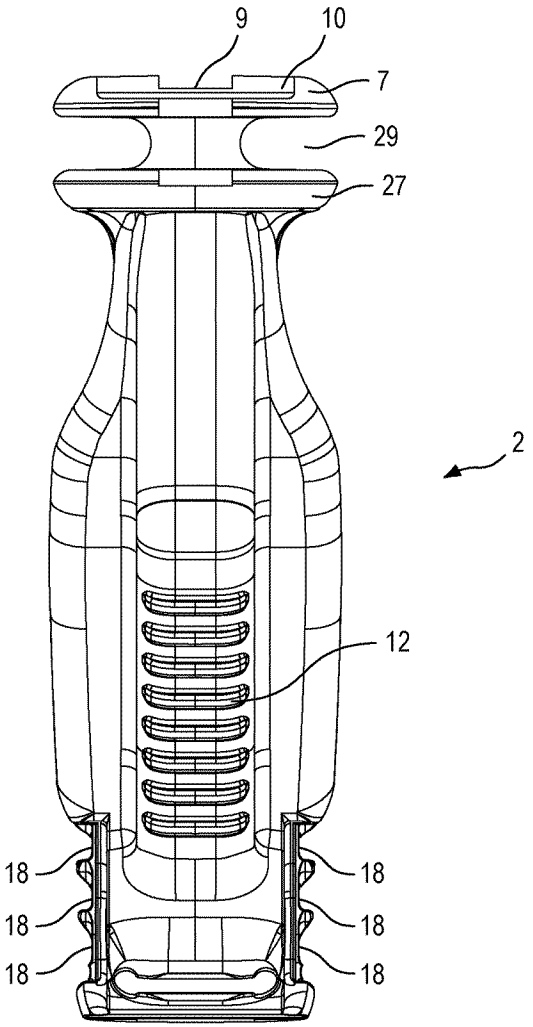
FIG. 16 is a front view of the handle of FIG. 10.
Figure 17:
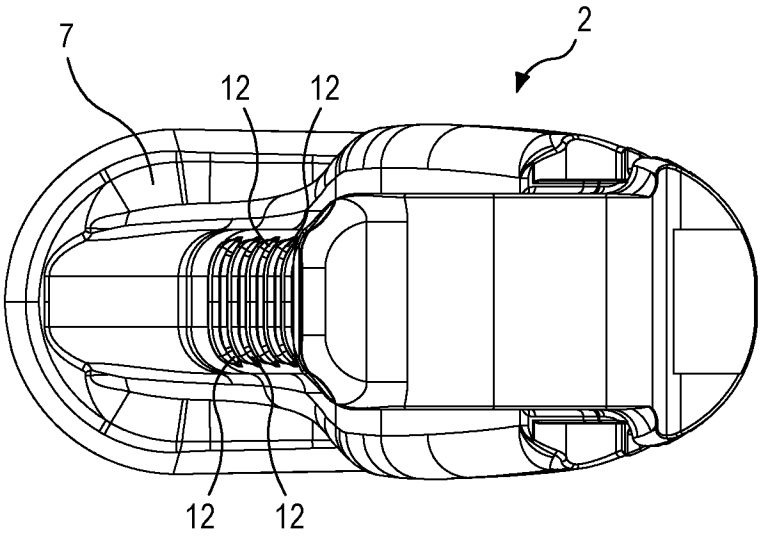
FIG. 17 is a bottom view of the handle of FIG. 10.
Figure 18:
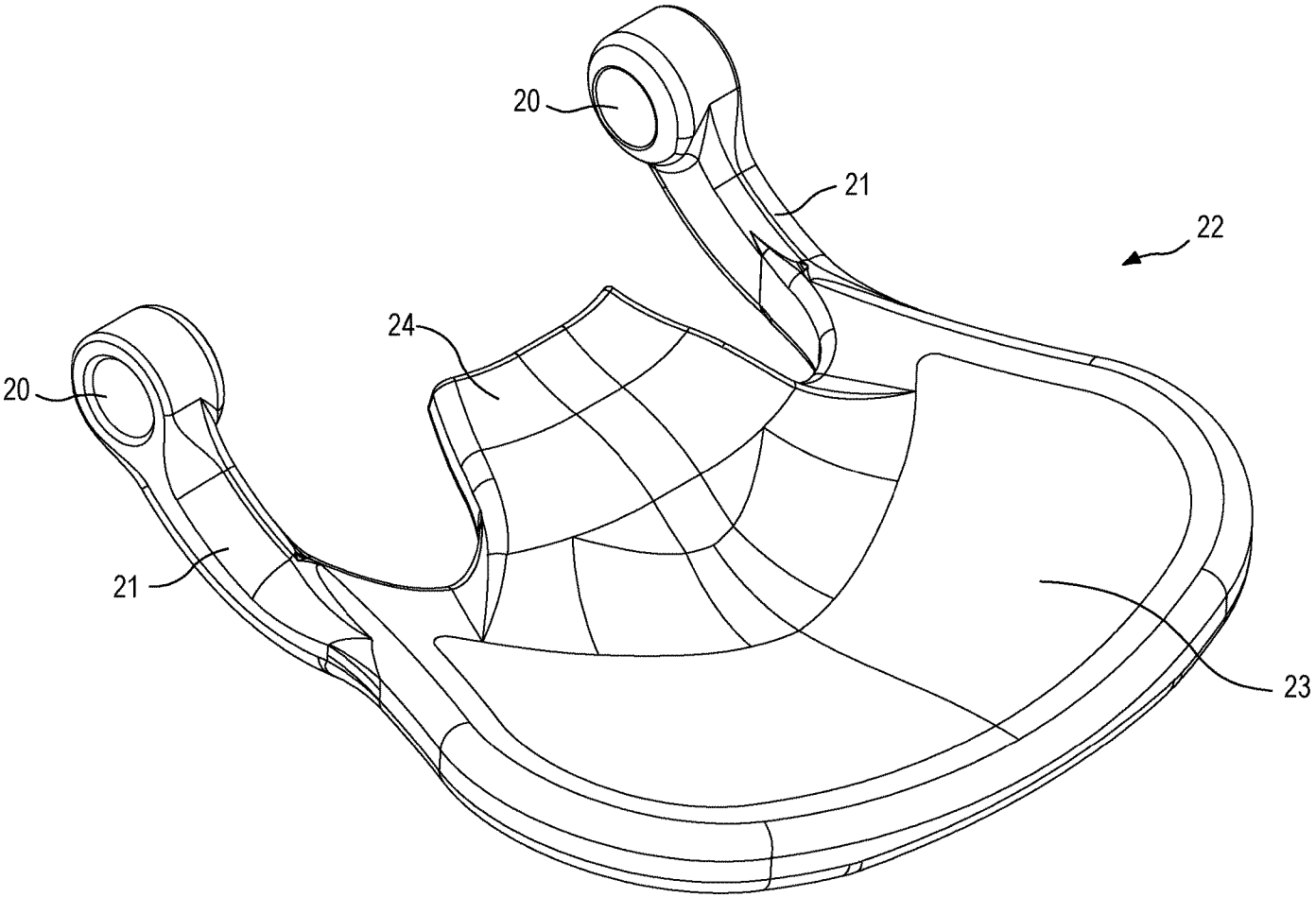
FIG. 18 is an enlarged perspective view of a palm plate of the slingshot according to one embodiment.
Figure 19:
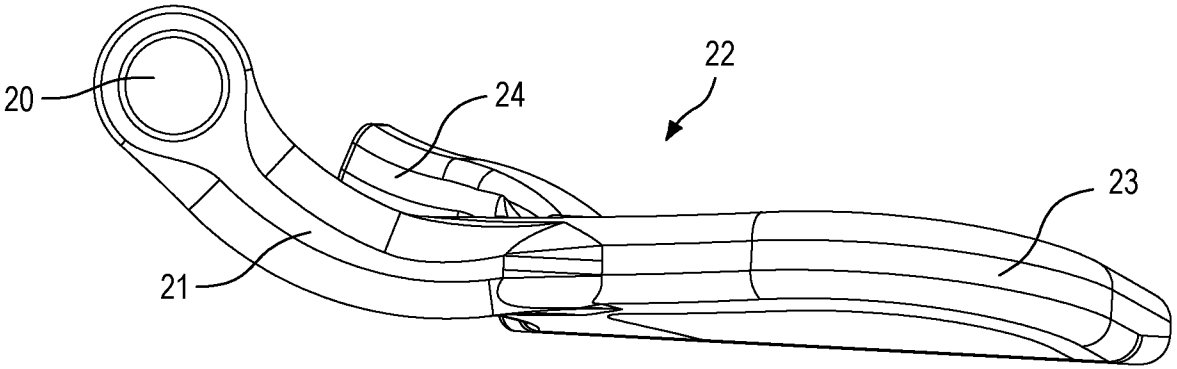
FIG. 19 is a left side view of the palm plate of FIG. 18.
Figure 20:
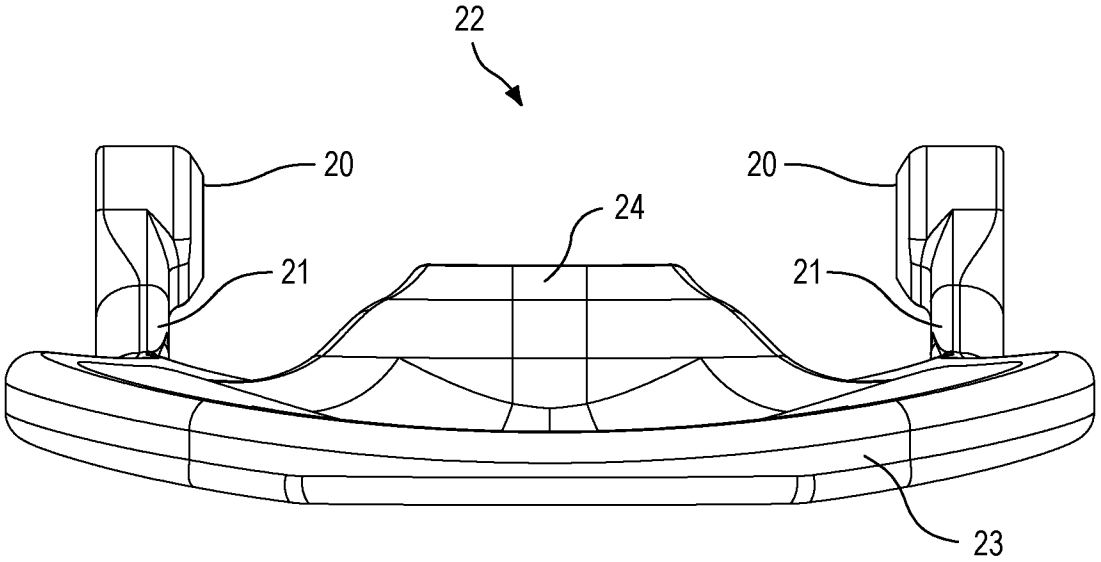
FIG. 20 is a front view of the palm plate of FIG. 18.
Figure 21:
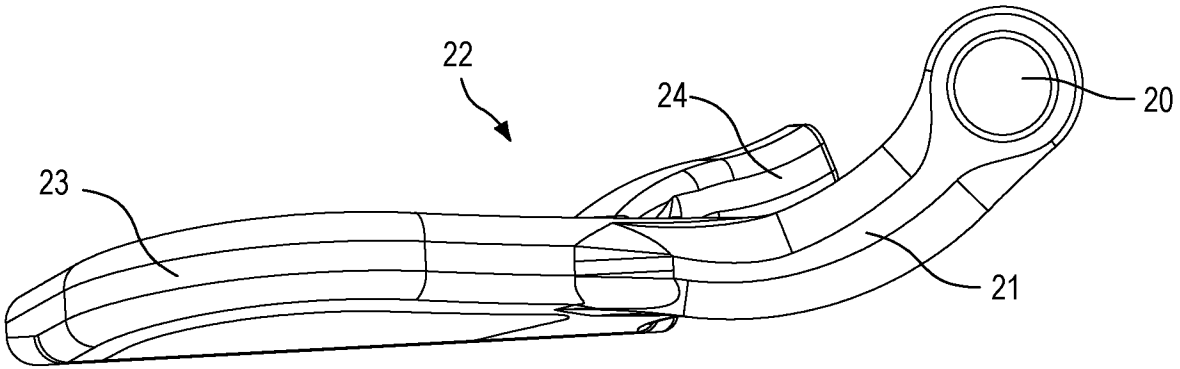
FIG. 21 is a right side view of the palm plate of FIG. 18.
Figure 22:
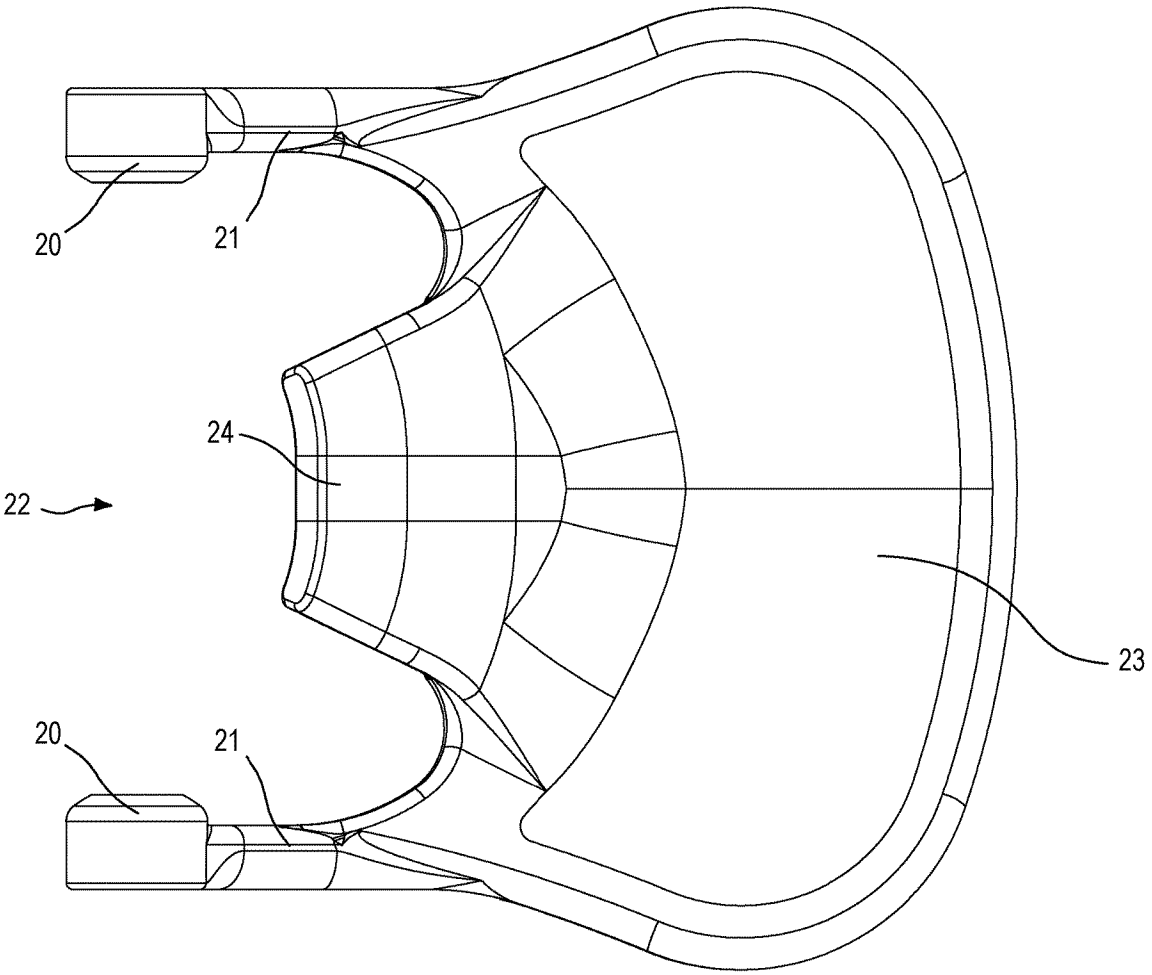
FIG. 22 is a top view of the palm plate of FIG. 18.
Figure 23:
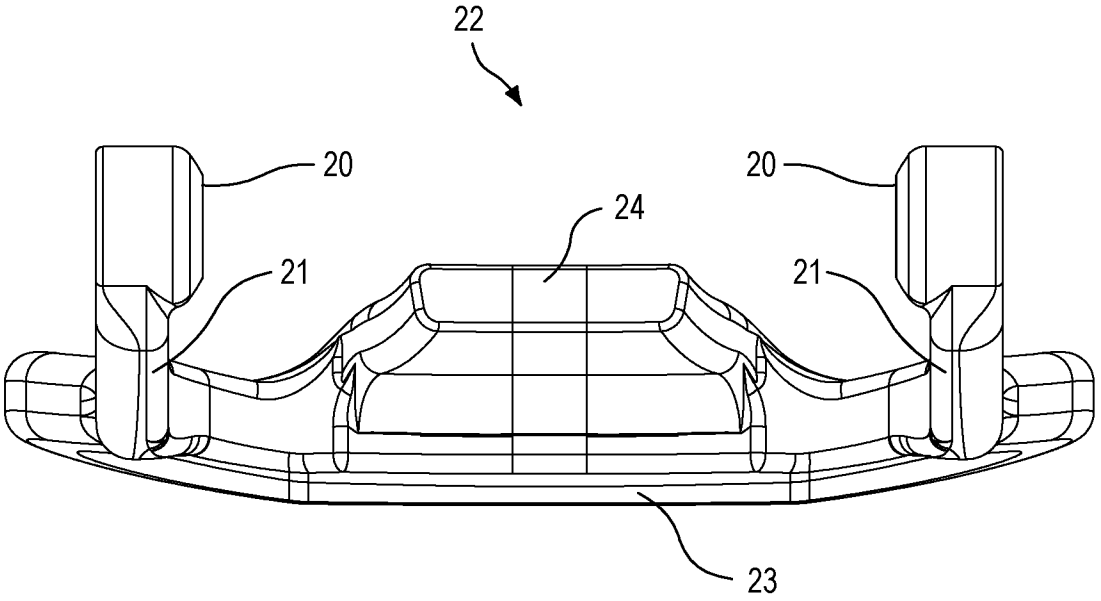
FIG. 23 is a rear view of the palm plate of FIG. 18.
Figure 24:
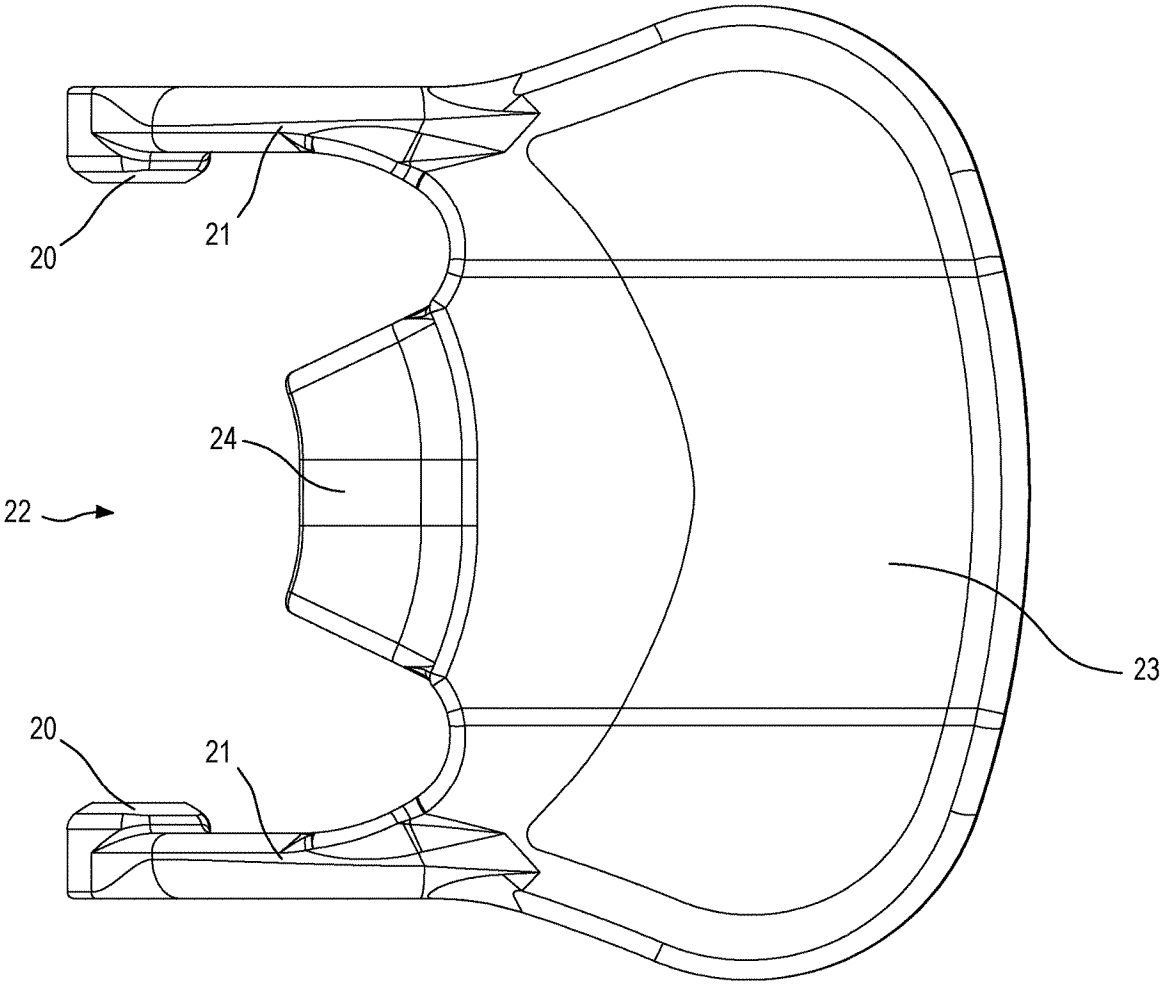
FIG. 24 is a bottom view of the palm plate of FIG. 18.
Figure 25:
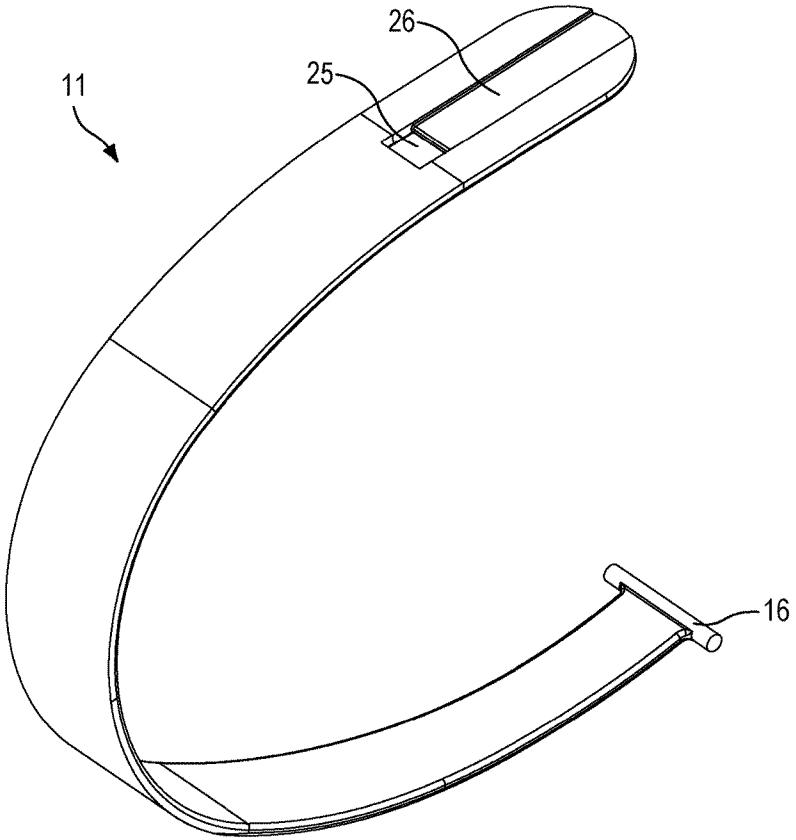
FIG. 25 is an enlarged perspective view of a handle guard embodying the principles of the claimed device.
Figure 26:
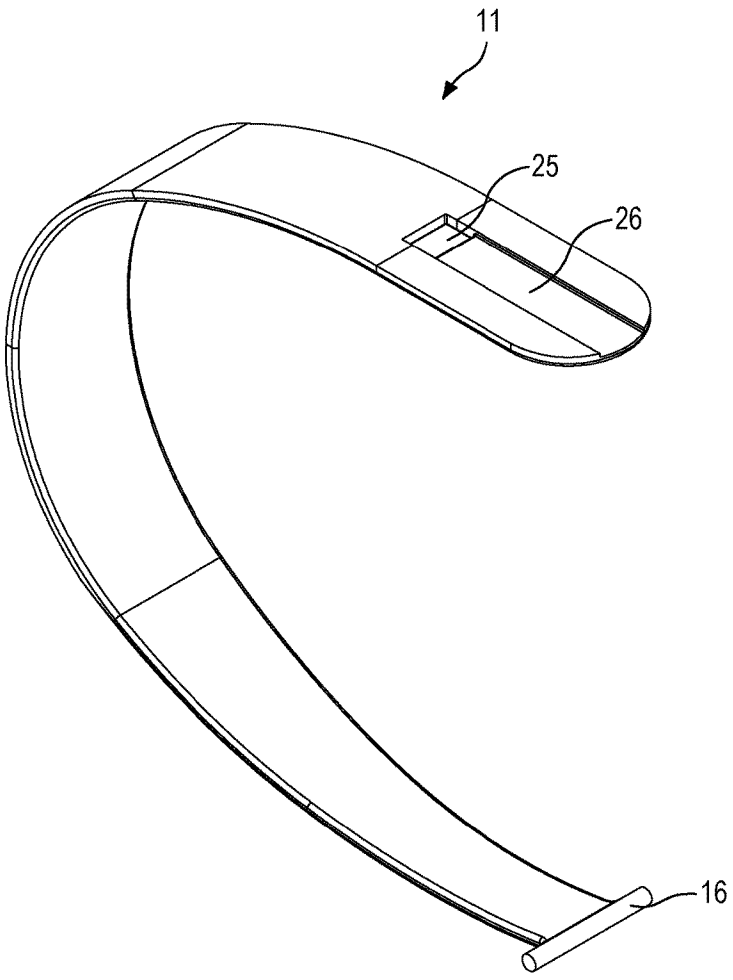
FIG. 26 is a perspective view of the handle guard of FIG. 25.
Figure 27:
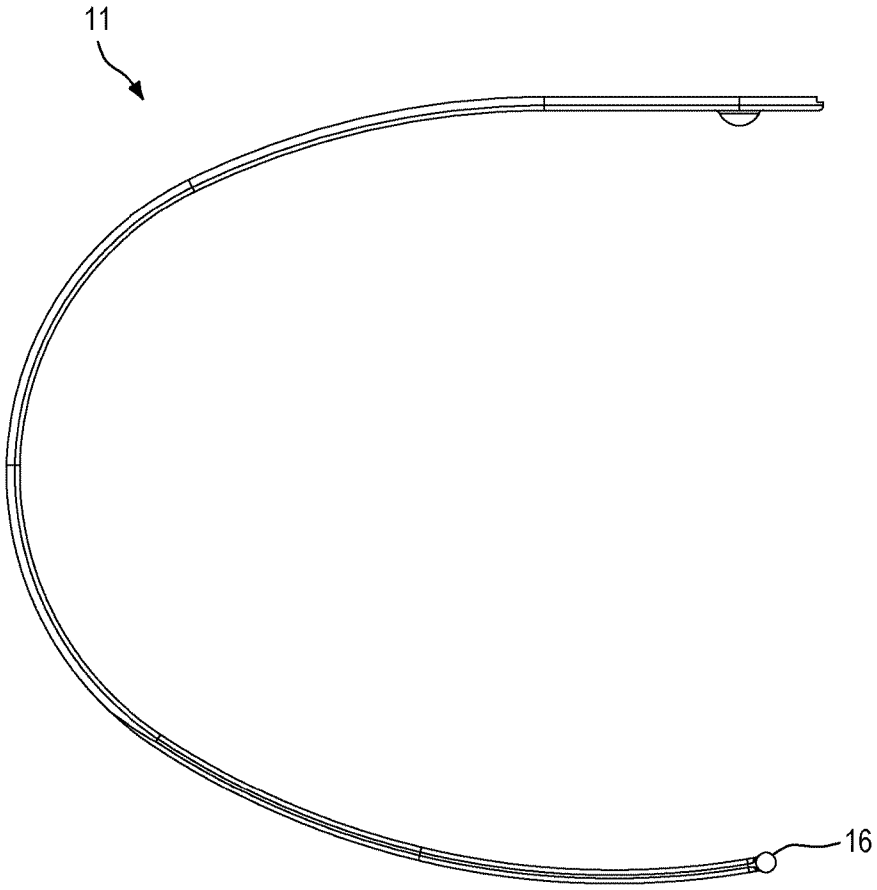
FIG. 27 is a right side view of the handle guard of FIG. 25.
Figure 28:
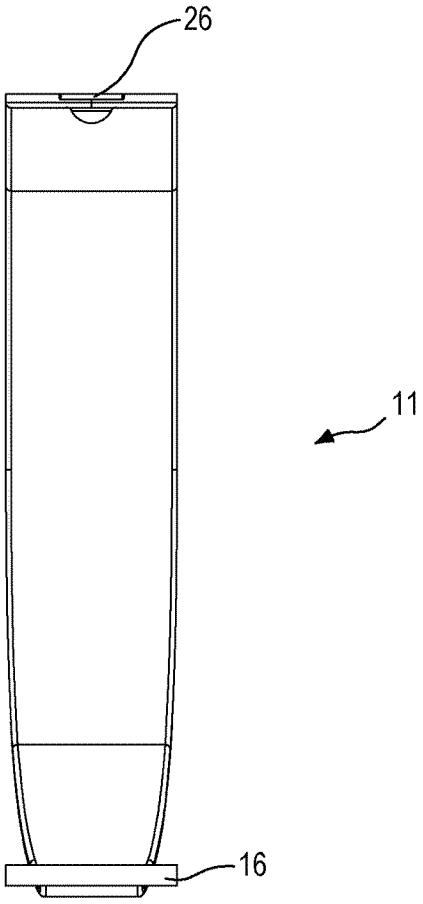
FIG. 28 is a rear view of the handle guard of FIG. 25.
Figure 29:
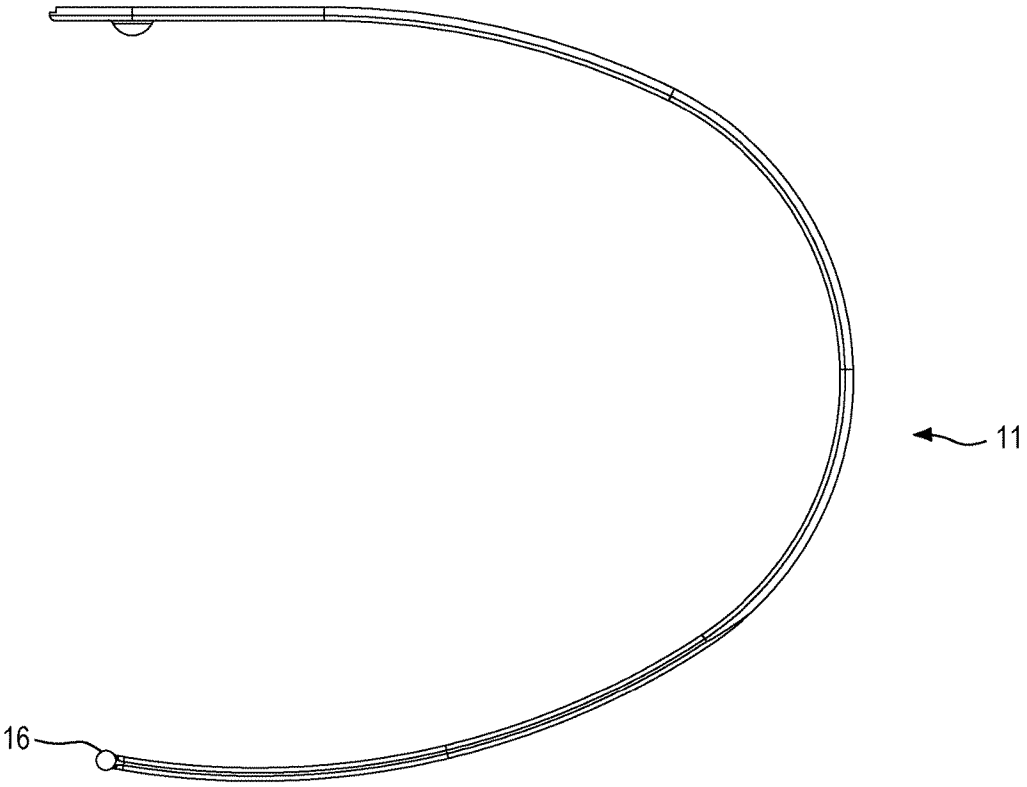
FIG. 29 is a left side view of the handle guard of FIG. 25.
Figure 30:
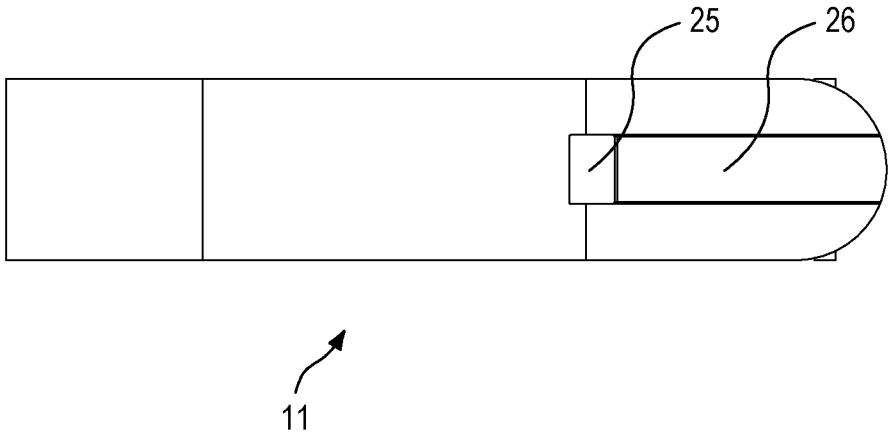
FIG. 30 is a top view of the handle guard of FIG. 25.
Figure 31:
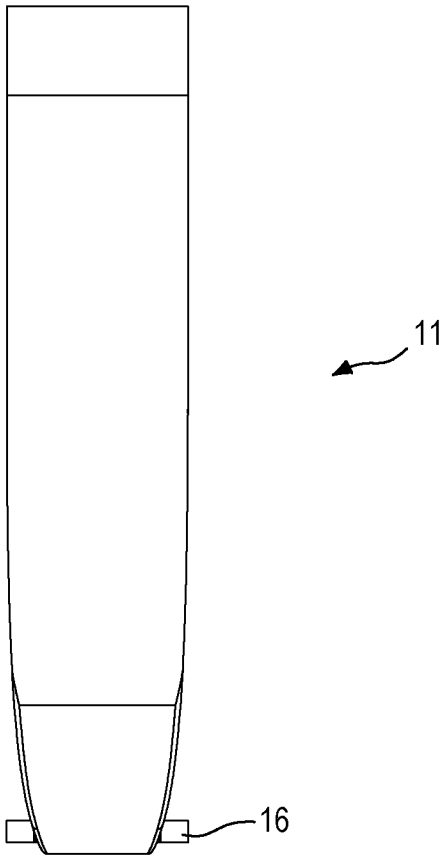
FIG. 31 is a view of the handle guard of FIG. 25.
Figure 32:
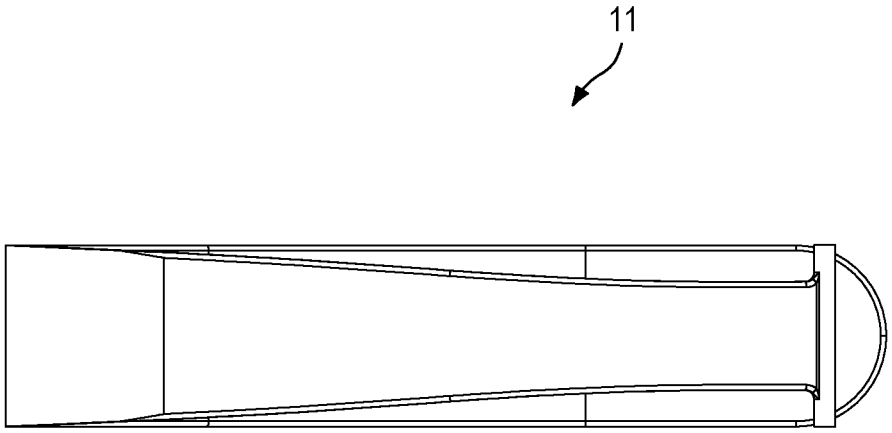
FIG. 32 is a view of the handle guard of FIG. 25.
Figure 33:
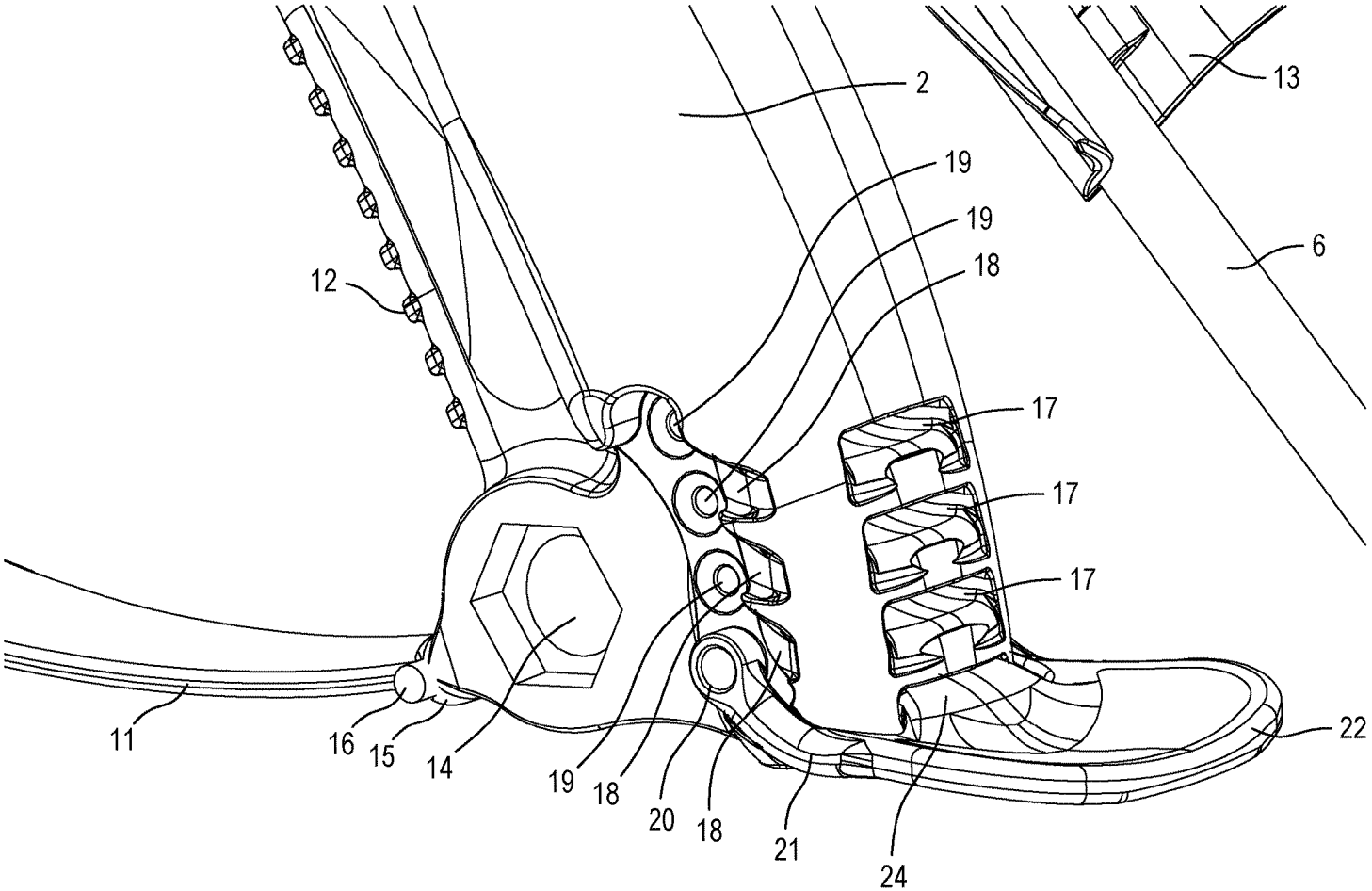
FIG. 33 is an enlarged fragmentary view of the slingshot of FIG. 2.
Figure 34:
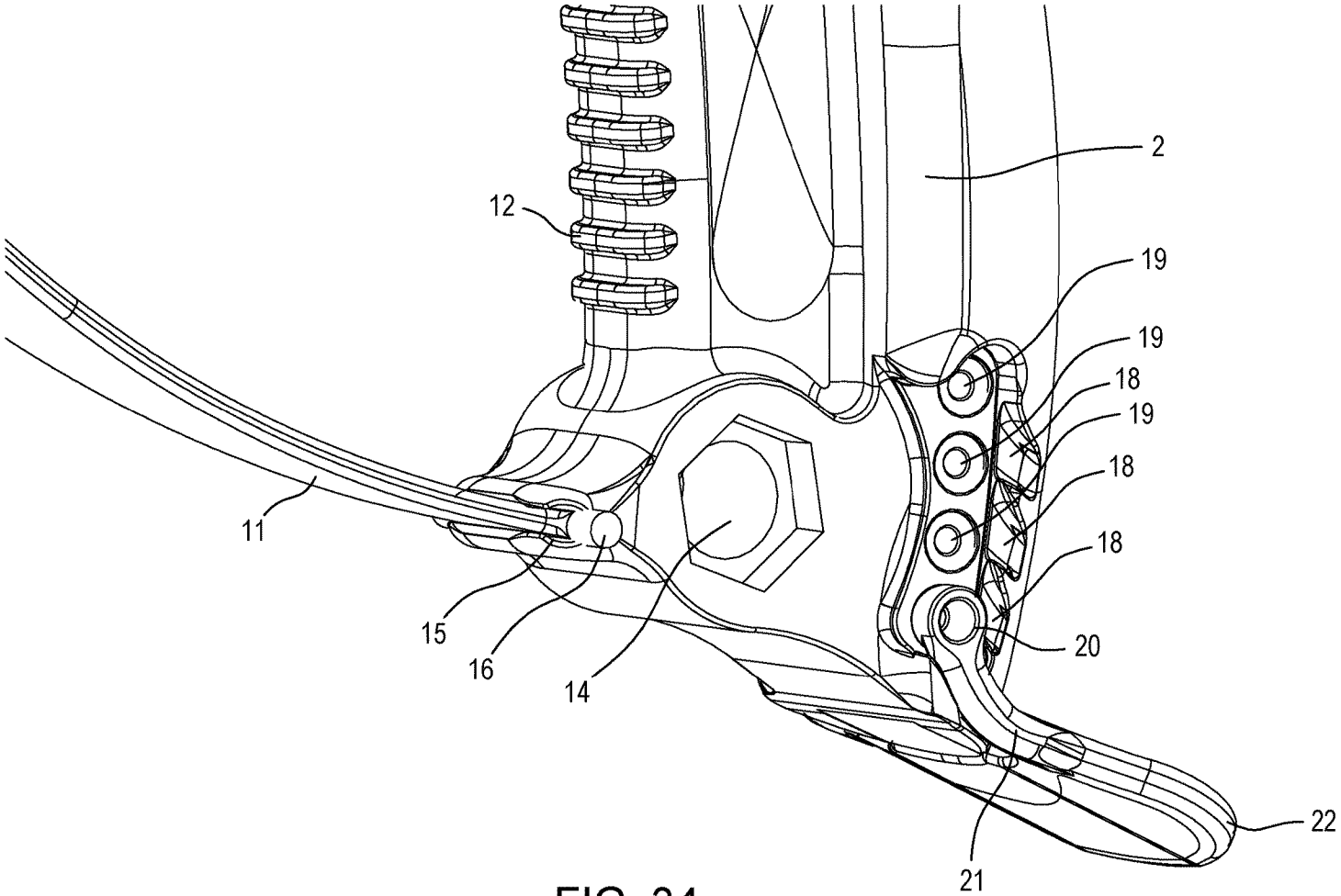
FIG. 34 is an enlarged fragmentary view of the slingshot of FIG. 2.
Figure 35:
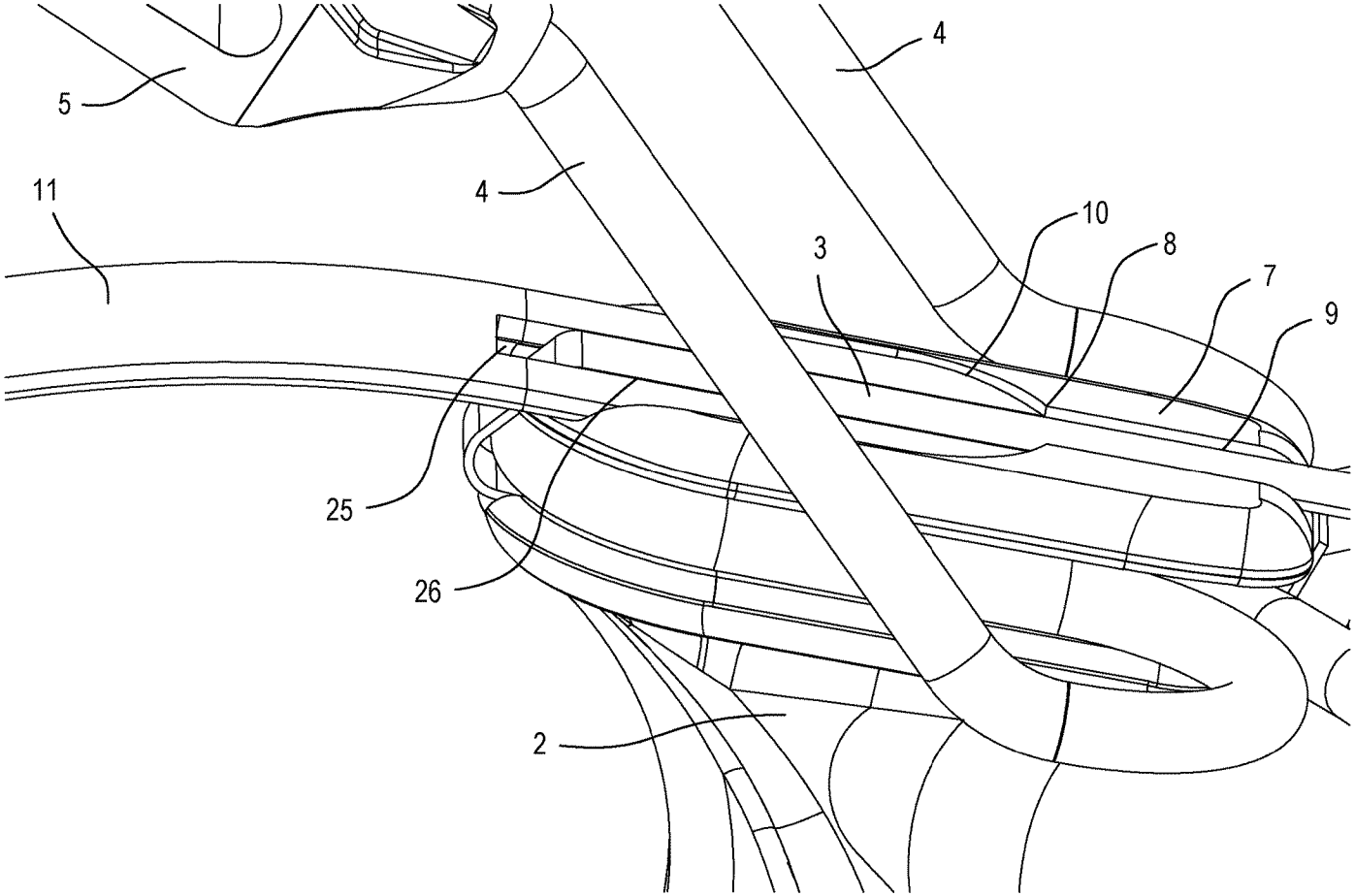
FIG. 35 is an enlarged fragmentary view of the slingshot of FIG. 2.

The forward face of handle 2, at the gripping portion 28, is formed with grips 12 to aid a user's gripping of handle 2. Beneath grips 12 is a bore 14 extending through handle 2 and configured to permit attachment of various accessories to handle 2, such as stabilizers, dampeners, storage containers and the like (not shown). It will be appreciated that such accessories may be permanently or, preferably, removably attached to handle 2 using various attachment methods, such as bolts and nuts (in which case bore 14 may be formed with a hexagonal recess (as shown in FIG. 2) in order to retain a nut), threaded members and other methods and components as are known to those skilled in the art.

A groove 15 is formed at the bottom of the forward face of handle 2. Groove 15 is dimensioned to slidably receive a tongue 16 formed at one end of handle guard 11 in order to secure handle guard 11 to the bottom the forward face of handle 2.

In the bottom portion of the rearward face of the gripping portion 28 of handle 2, a plurality of positioning elements are formed extending from the bottom of the rearward face of handle 2 and spaced apart upwardly for a distance along the rearward face of handle 2. The positioning elements may be, for example, a plurality of grooves 17. In addition, the positioning elements may include a plurality of recesses 18 formed on the left and right sides of handle 2 to accompany grooves 17. For example, each groove 17 may be associated with a pair of recesses 18, with respective recesses 18 of the pair positioned at opposite sides of the groove 17. Each recess 18 comprises a post 19 configured to matingly engage a collar 20 formed on opposing arms 21 of a palm plate 22, as further discussed below. In this matter, palm plate 22 may be positioned at multiple positions along the length of handle 2 to accommodate hands of various sizes, as further discussed below.

In the disclosed embodiment of the claimed device, handle 2 of slingshot 1 is formed as a single piece of rigid molded plastic. However, those skilled in the art will recognize that other suitable materials, preferably rigid, lightweight, and strong, may be used to form handle 2 of slingshot 1 without departing from the scope of the present disclosure. Similarly, those skilled in the art will recognize that handle 2 need not be molded as a single piece and may instead comprise individual pieces affixed to one another.

Palm plate 22 is a small, plate-like member comprising a body 23, a pair of arms 21 extending rearwardly and upwardly from body 23, and a lip 24 extending rearwardly from body 23 and disposed between arms 21. Arms 21 are formed with collars 20 at the distal ends thereof. Collars 20 are dimensioned to straddle at least a portion of the handle and matingly engage posts 19 of recesses 18 of handle 2, while lip 24 is dimensioned to matingly engage grooves 17 of handle 2.

In this manner, palm plate 22 is detachable from handle 2 and moveable between fixed positions along the length of handle 2. For example, for a user with a relatively small hand, palm plate 22 may be moved to the uppermost groove 17 of handle 2 and the corresponding uppermost recesses 18 of handle 2. Lip 24 of palm plate 22 is inserted into uppermost groove 17 of handle 2 while collars 20 of arms 21 of palm plate 22 are engaged with posts 19 of the corresponding uppermost recesses 18 of handle 2. For a user with a relatively large hand, palm plate 22 may be moved to the lowermost groove 17, recesses 18 and posts 19 in the same manner. It will be appreciated that arms 21 of palm plate 22 have a slight degree of flexibility in order to allow palm plate 22 to be attached and detached as described above.

Palm plate 22 provides support for a user's hand when holding slingshot 1 during shooting and provides additional stability. Palm plate 22 also may advantageously create a slight counter-torque during draw of the band, complementing arm brace 6. Other benefits of palm plate 22 will be evident to those skilled in the art.

In the disclosed embodiment of the claimed device, palm plate 22 of slingshot 1 is formed as a single piece of generally rigid molded plastic (although arms 21 may have slight degree of flexibility as noted above). However, those skilled in the art will recognize that other suitable materials, preferably rigid, lightweight, and strong, may be used to form palm plate 22 without departing from the scope of the present disclosure. Similarly, those skilled in the art will recognize that palm plate 22 need not be molded as a single piece and may instead comprise individual pieces affixed to one another.

Handle guard 11 is a generally thin, flexible, strap-like member that extends forwardly from handle 2 of slingshot 1 in a generally arcuate manner, from the bottom of the forward face of handle 2 to the top 7 of handle 2. A tongue 16 is formed at one end of handle guard 11, tongue 16 being dimensioned to matingly engage groove 15 formed at the bottom of the forward face of handle 2, as discussed above. In the disclosed embodiment of handle guard 11, tongue 16 slides into groove 15 from either the left or right side of handle 2 in order to secure one end of handle guard 11 to the bottom forward face of handle 2.

At the other end of handle guard 11 are formed an aperture 25 and an elongated recess 26 adjacent to the aperture. Aperture 25 is dimensioned to receive retaining clip 3 therethrough while elongated recess 26 is dimensioned to receive a portion of retaining clip 3. To attach this end of handle guard 11 to handle 2, retaining clip 3 is detached from handle 2. Handle guard 11 is positioned within end 10 of recess 8 of top 7 of handle 2 and retaining clip 3 is passed through aperture 25 and reattached to handle 2 while positioned within elongated recess 26 of handle guard 11 and elongated recess 8 of top 7 of handle 2.

When handle guard 11 is attached to top 7 of handle 2 and bottom forward face of handle 2, handle guard 11 extends forwardly from handle 2 in a curved or bowed manner. In this position, handle guard 11 prevents the band from contacting the handle (and the user's hand holding the handle) during recoil.

In the disclosed embodiment of the claimed device, handle guard 11 is formed as a single piece of flexible plastic. However, those skilled in the art will recognize that other suitable materials, preferably flexible, lightweight, and strong, may be used to form handle guard 11 without departing from the scope of the present disclosure.

FIGS. 36-42 illustrate various views of another embodiment of a handle 202 of a slingshot 1. FIGS. 43-49 illustrate various views of another embodiment of a palm plate 222 used together with the handle 202 of the slingshot 1. It is understood that various features of the embodiment shown in FIGS. 36-49 may be similar or identical to the features described above with reference to FIGS. 1-35, and that further description of these features may be omitted below. In addition, certain features described below that are similar or identical to features described above may be referenced below and shown in FIGS. 36-49 using the same reference numbers as above.

Referring to FIGS. 36-42, the handle 202 includes a plurality of positioning elements in a bottom portion of a rearward face of the handle 202, and in particular, the gripping portion 228. The positioning elements are spaced apart upwardly for a distance along the rearward face of the handle 202. In this embodiment, the positioning elements may include, for example, a plurality of grooves 217. In addition, the positioning elements include a plurality of enlarged channels 218, each enlarged channel 218 formed integrally and continuously with a corresponding groove 217. That is, each groove 217 is associated a respective enlarged channel 218.

Figure 36:
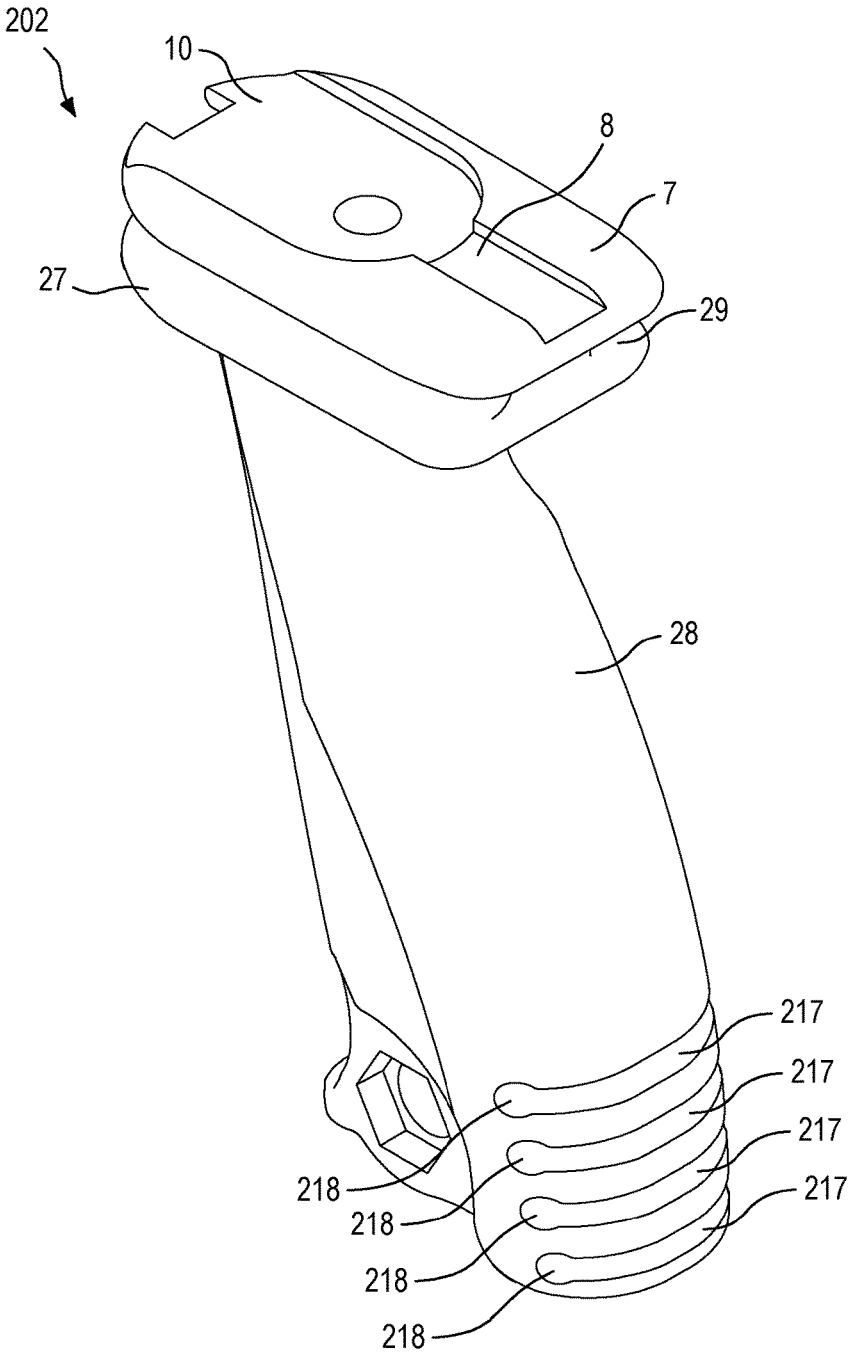
FIG. 36 is an enlarged perspective view of a handle of the slingshot according to another embodiment.
Figure 37:
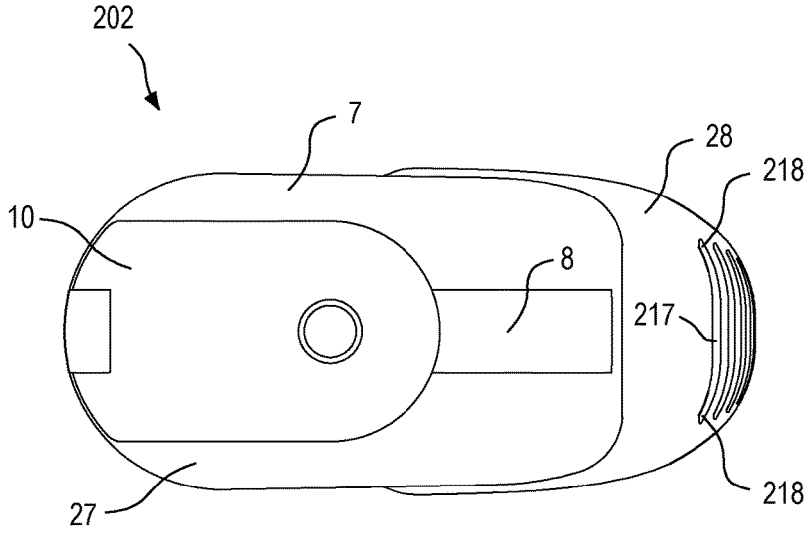
FIG. 37 is a top view of the handle of FIG. 36.
Figure 38:
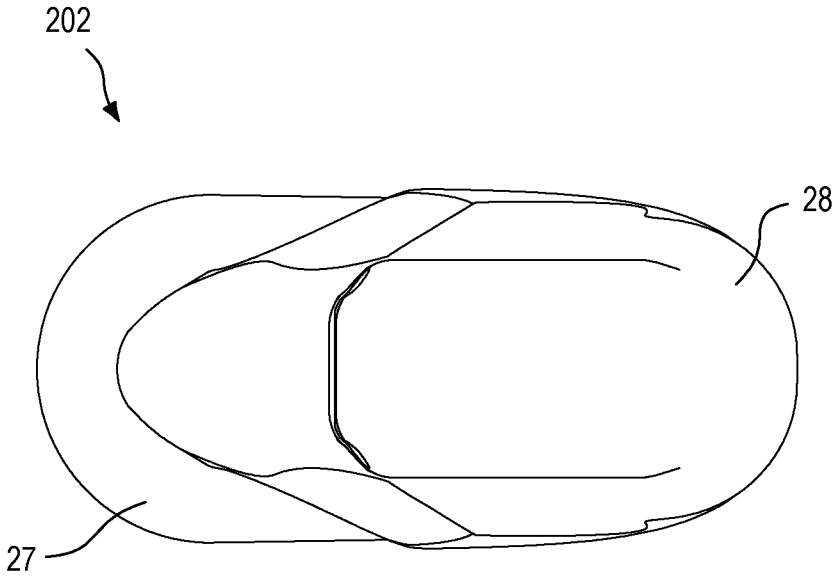
FIG. 38 is a bottom view of the handle of FIG. 36.
Figure 39:
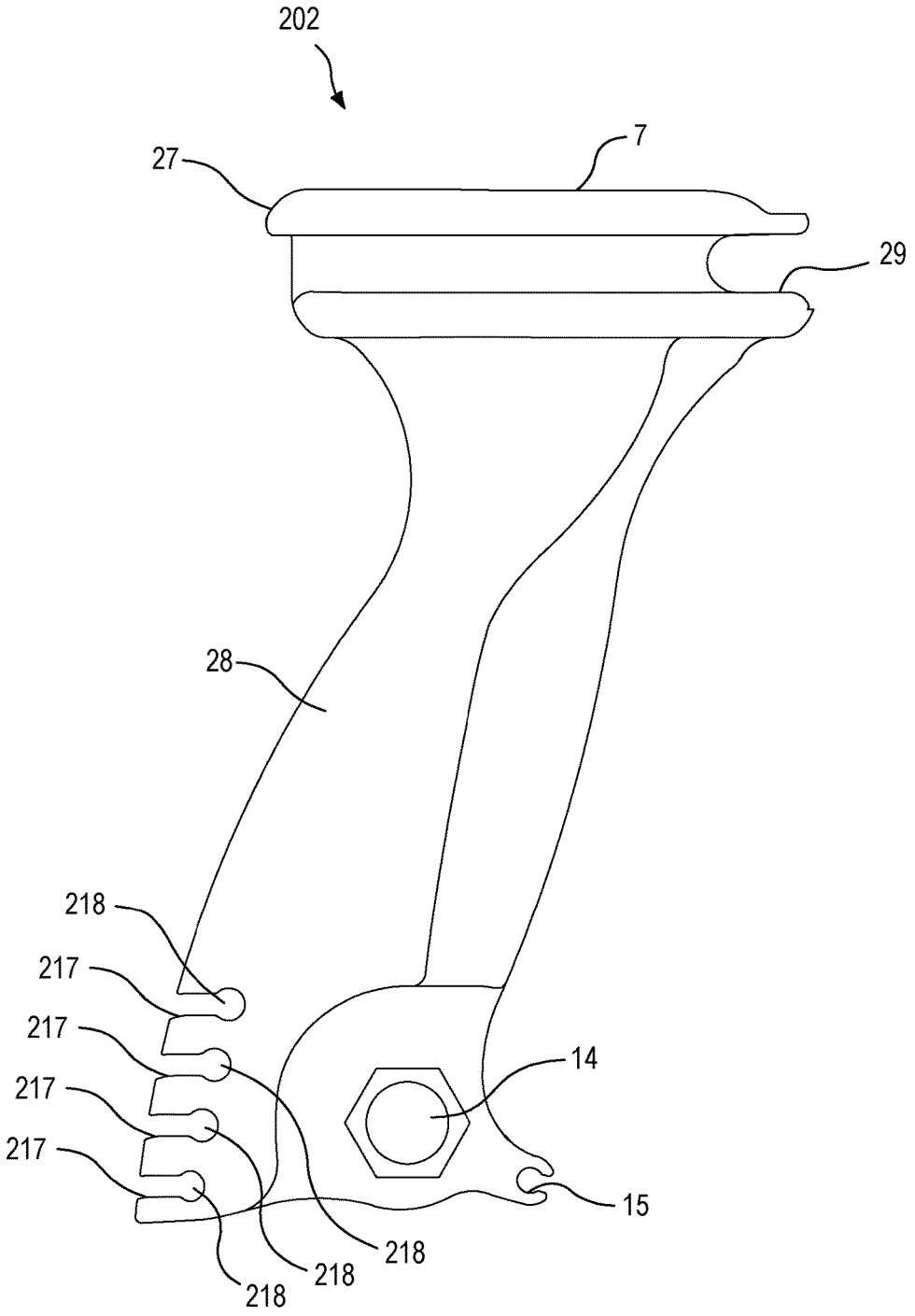
FIG. 39 is a left side view of the handle of FIG. 36.
Figure 40:
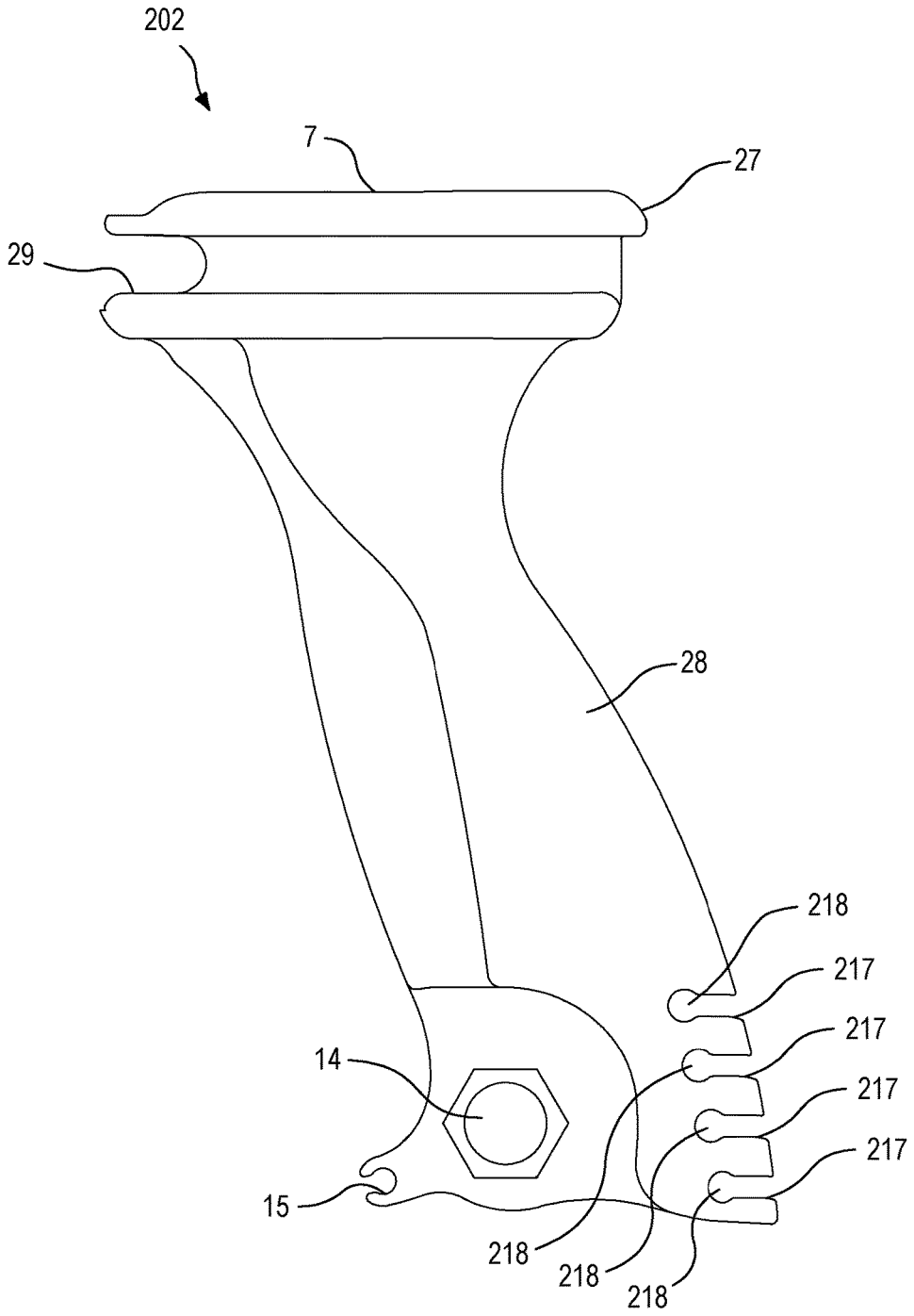
FIG. 40 is a right side view of the handle of FIG. 36.
Figure 41:
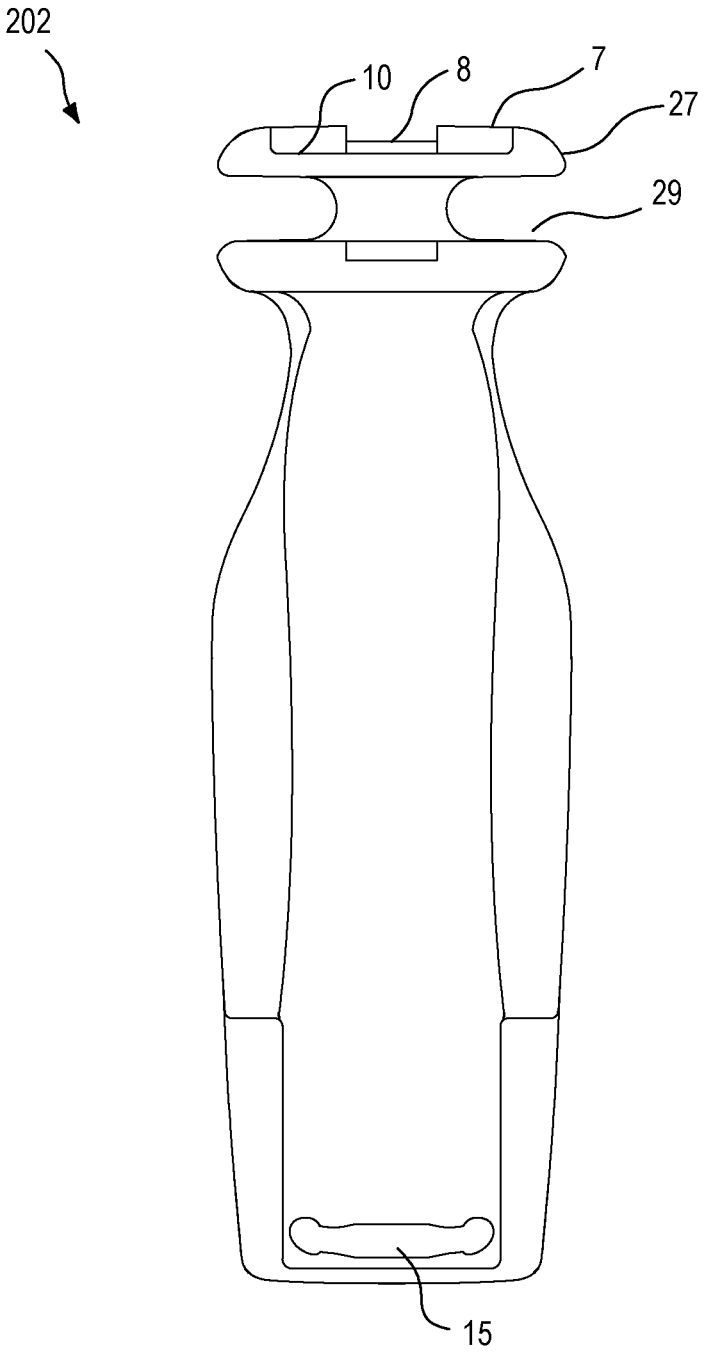
FIG. 41 is a front view of the handle of FIG. 36.
Figure 42:
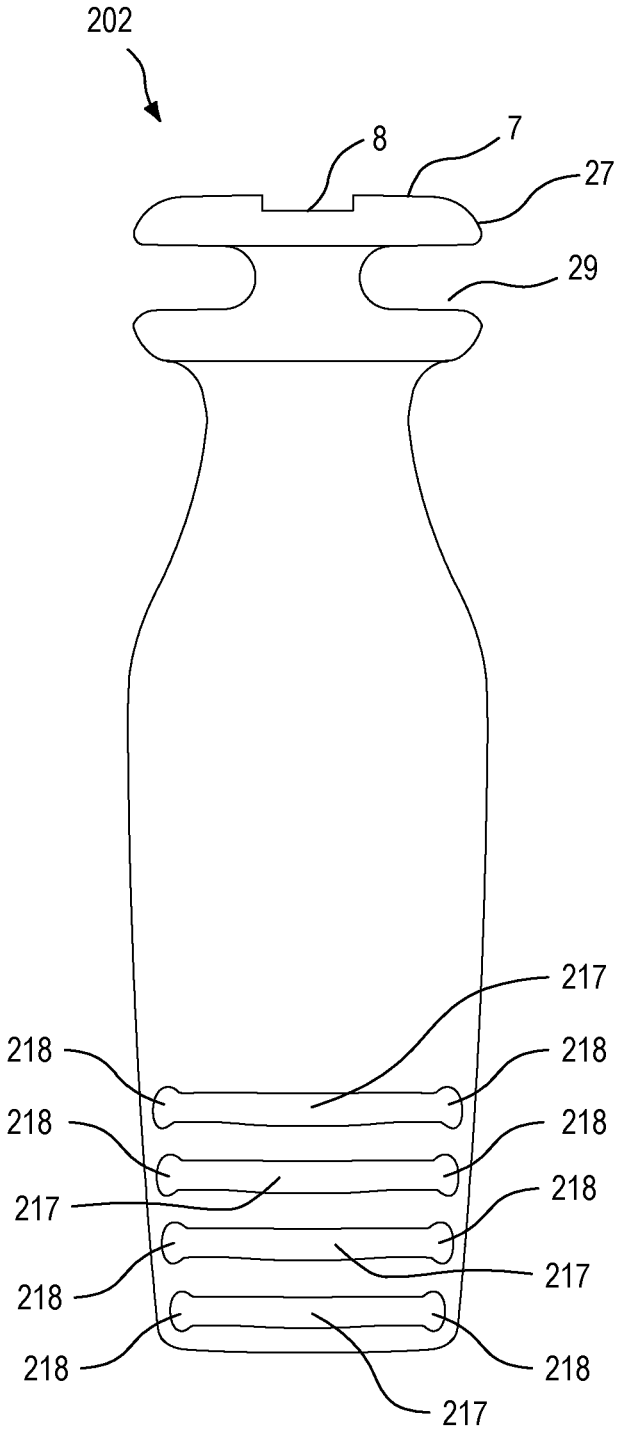
FIG. 42 is a rear view of the handle of FIG. 36.
Figure 43:
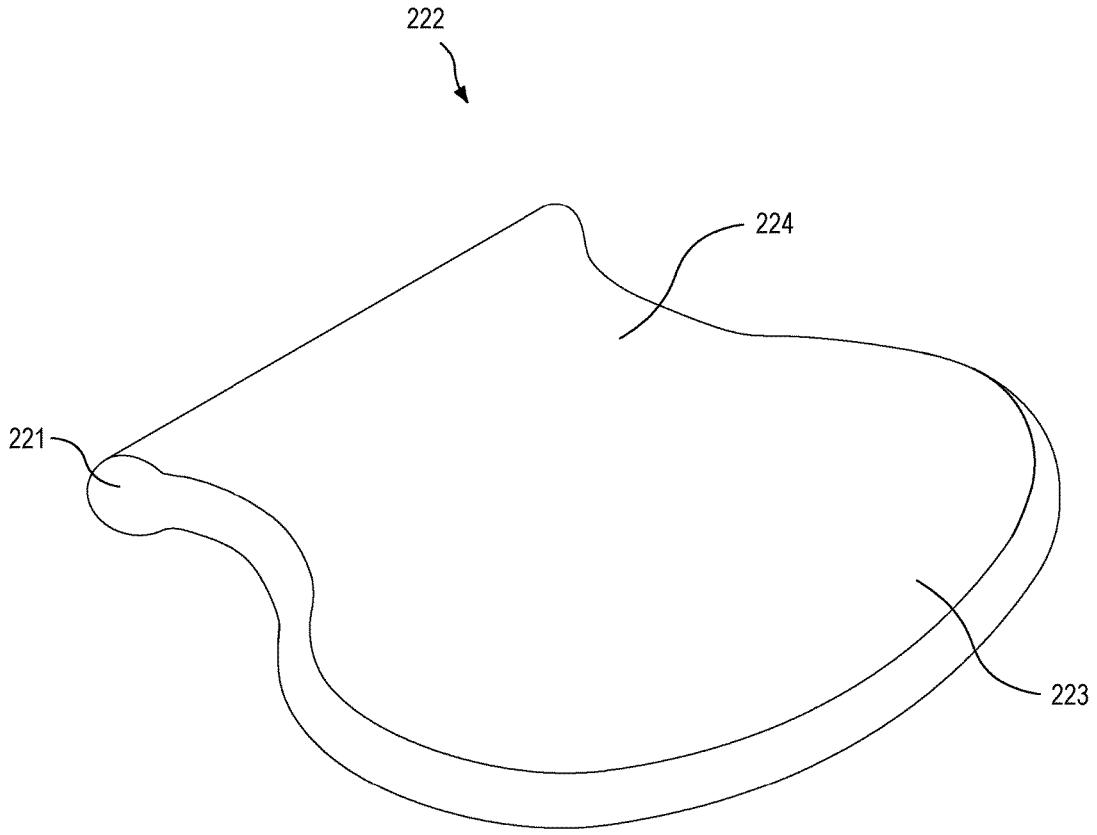
FIG. 43 is an enlarged perspective view of a palm plate of the slingshot according to another embodiment.
Figure 44:
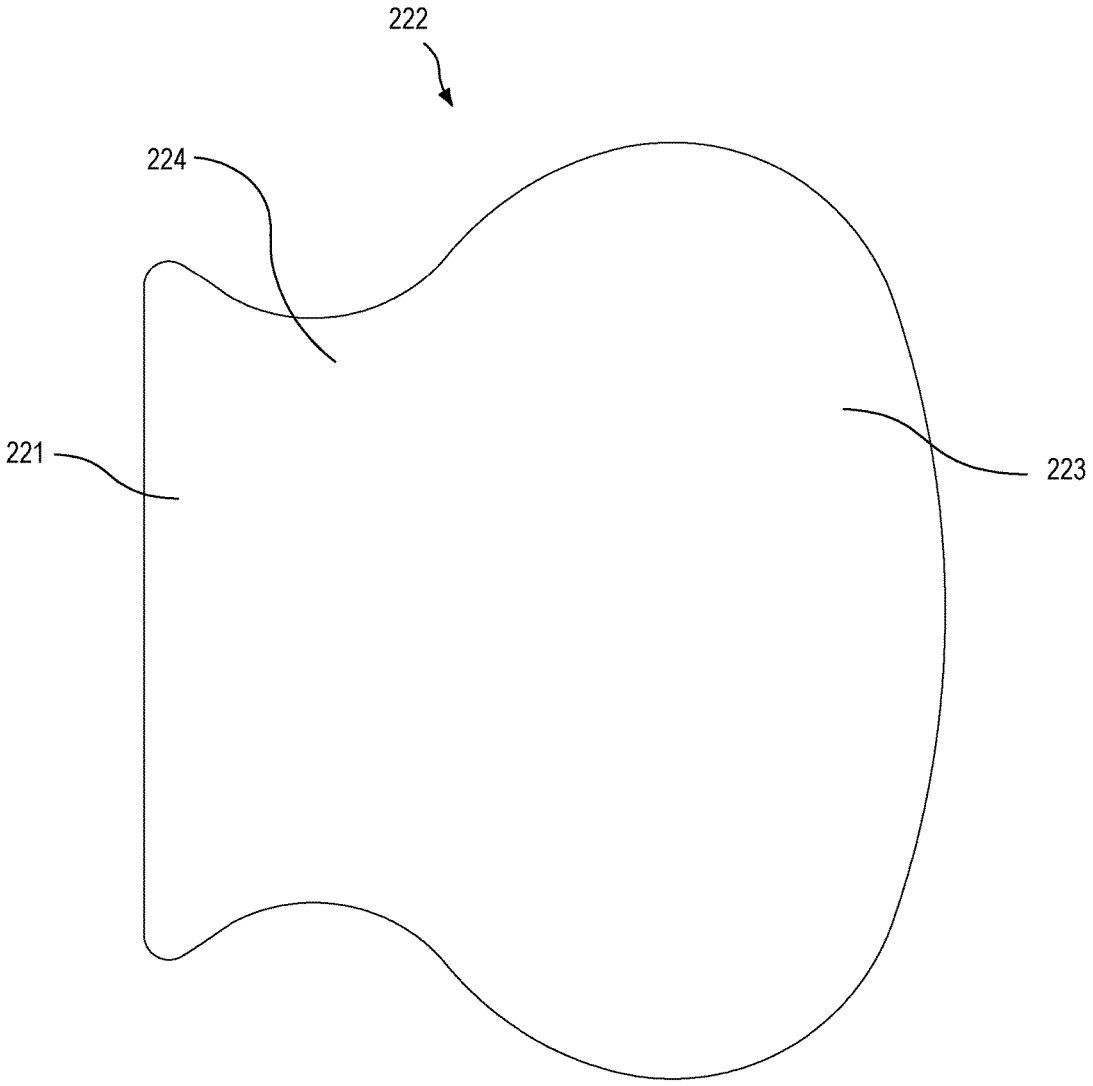
FIG. 44 is a top view of the palm plate of FIG. 43.
Figure 45:
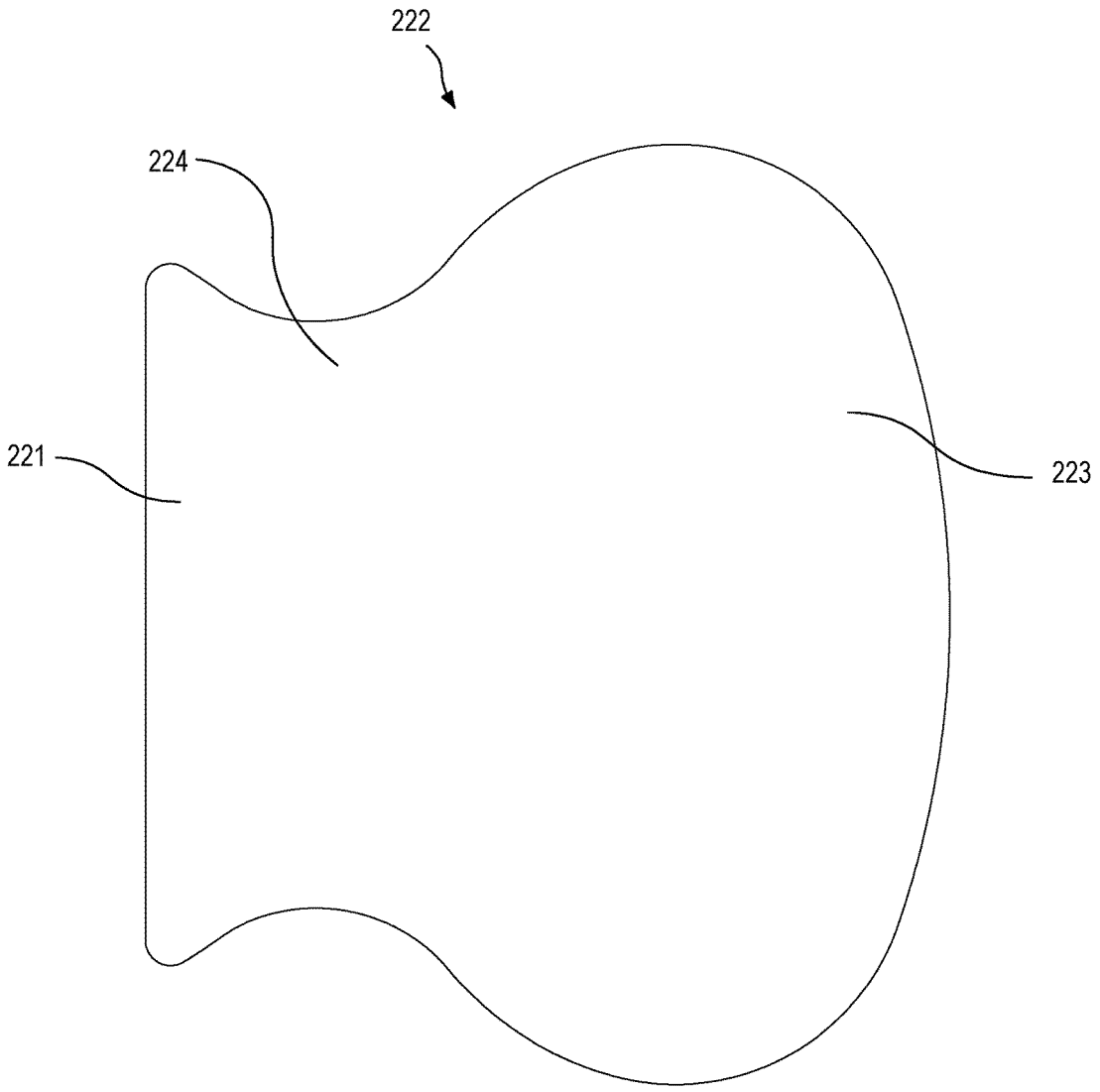
FIG. 45 is a bottom view of the palm plate of FIG. 43.
Figure 46:
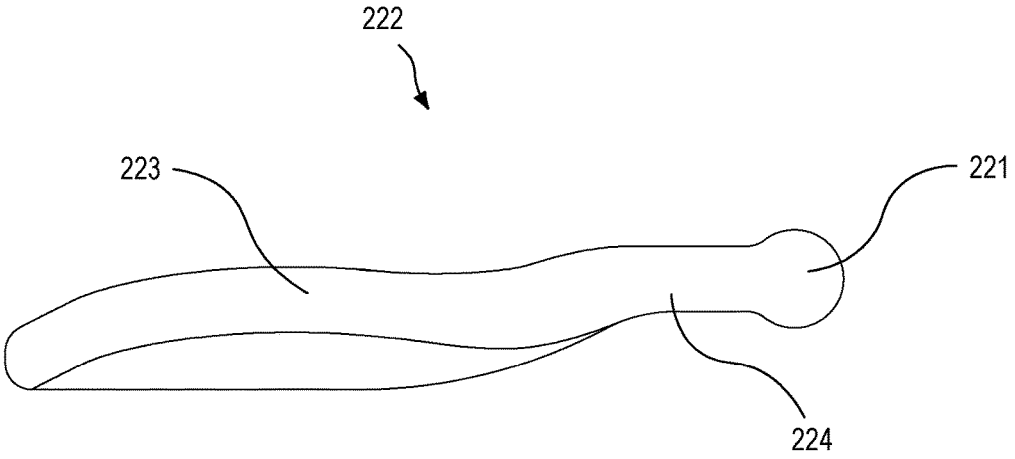
FIG. 46 is a left side view of the palm plate of FIG. 43.
Figure 47:
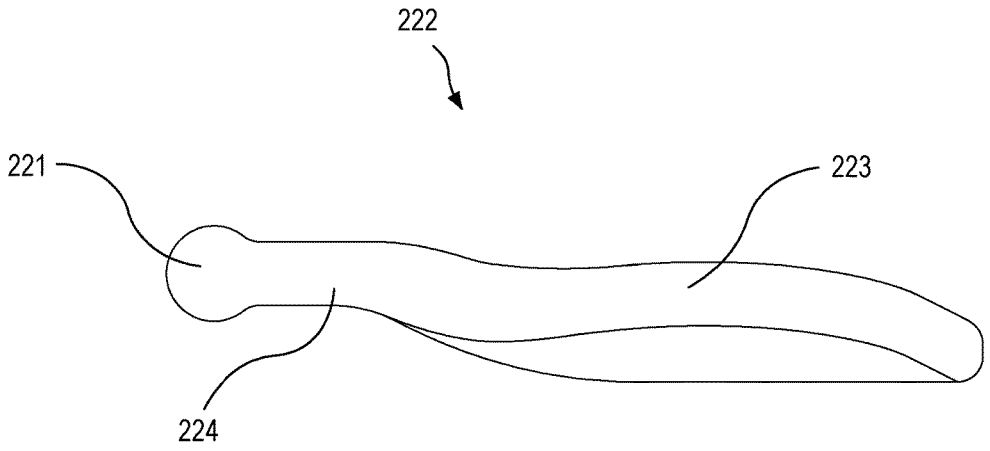
FIG. 47 is a right side view of the palm plate of FIG. 43.
Figure 48:
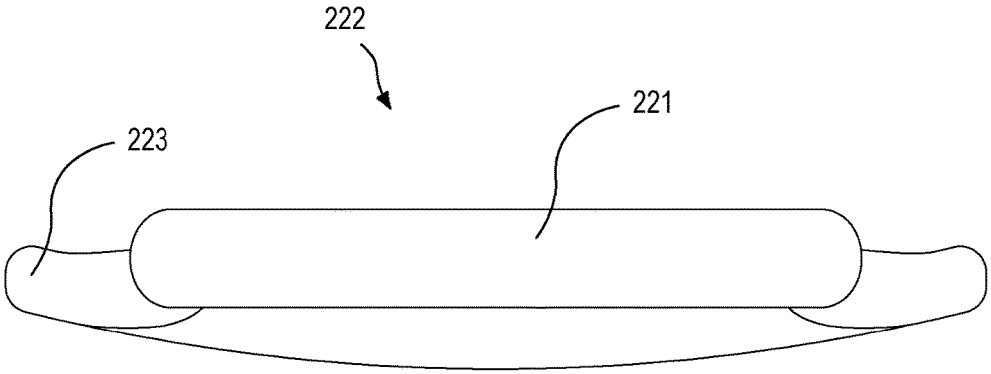
FIG. 48 is a front view of the palm plate of FIG. 43.
Figure 49:
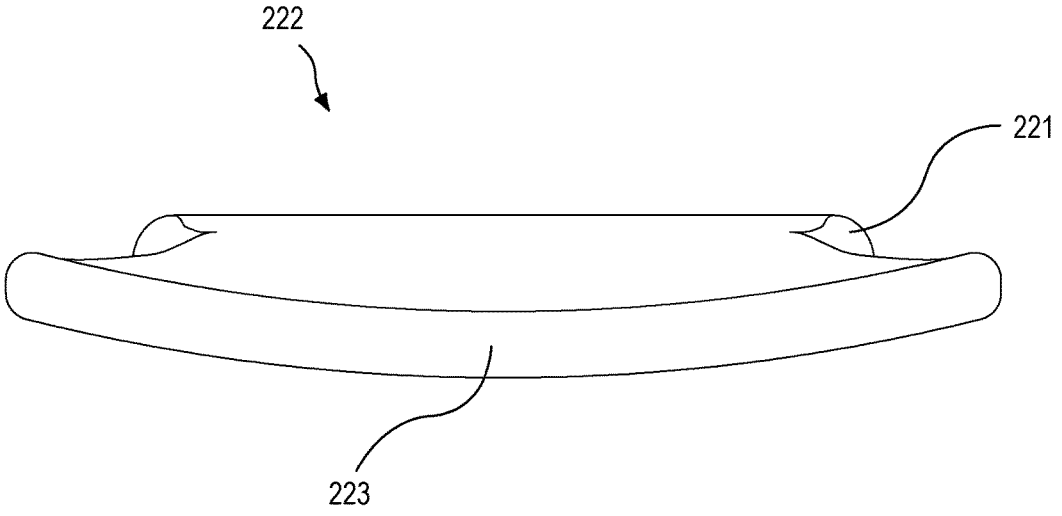
FIG. 49 is a rear view of the palm plate of FIG. 43.

The enlarged channel 218 extends from a left side to right side of the handle 202 across an interior of the handle 202. As shown in FIG. 36, for example, the enlarged channels 218 have an increased thickness relative to the grooves 217, and may be formed in generally circular shape. It is understood, however, that the shape of the enlarged channels 218 is not limited to this configuration, and other suitable shapes are envisioned as well.

Referring to FIGS. 43-49, the palm plate 222 is a plate-like member comprising body 223, intermediate lip 224, and an enlarged tongue 221. The palm plate 222 is configured to be removably received in a positioning element, for example, within the one of the grooves 217 and an associated enlarged channel 218. The palm plate 222 may be received in, and removed from, the groove 217 and associated large channel 218 through a side of the groove 217 and associated large channel 218, for example, substantially at a right or left side of the handle 202.

The enlarged tongue 221 is configured to be received in enlarged channel 218 and the intermediate lip 224 may be received in the groove 217. As noted above, the palm plate 222 may be moved across the groove 217. The engagement between the enlarged tongue 221 and the enlarged channel 218 retains the palm plate 222 in the handle 202. That is, the engagement between the enlarged tongue 221 and the enlarged channel 218 substantially restrains the palm plate 222 from rearward movement relative to the handle 202, and against unintended removal of the palm plate 222 from the handle 202. In the manner described above, palm plate 222 is detachable from handle 202 and moveable between fixed positions along the length of handle 202. For example, as described above, for a user with a relatively small hand, palm plate 222 may be moved to the uppermost groove 217 and corresponding enlarged channel 218 of handle 202. For a user with a relatively large hand, palm plate 222 may be moved to the lowermost groove 217 and corresponding enlarged channel 218.

It will be appreciated by those skilled in the art that the features described herein may be found in various combinations. That is, handle 2, handle guard 11, palm plate 22 and accessory attachment bore 14 may be used together in slingshot 1 or may be used individually and/or in any combination with other slingshot devices without departing from the scope of the present disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A slingshot, the slingshot comprising:

a handle including a plurality of grooves, the grooves spaced along a length of the handle and disposed on a rearward face of the handle;

a pair of forward facing arms extending upwardly and forwardly from the handle, each arm having a band attachment device;

an arm brace secured to the handle; and a palm plate removably secured to the handle within a first groove of the plurality of grooves, wherein the palm plate is removable from the first groove of the plurality of grooves and securable within a second groove of the plurality of grooves to adjust a position of the palm plate along the length of the handle such that a length of a gripping area on the handle between the palm plate and a top of the handle is adjustable, wherein the palm plate further includes a lip matingly engaged in one of the first groove and the second groove to removably secure the palm plate at a location along the length of the handle, and a body connected to the lip and configured to extend outwardly from the groove beyond the rearward face of the handle, and wherein each groove of the plurality of grooves is sized and shaped to matingly engage the lip of the palm plate to removably secure the palm plate to the handle.

2. The slingshot of claim 1, further comprising a retaining clip for securing the arm brace to the handle.

3. The slingshot of claim 1, the arm brace further comprising a bail guard.

4. The slingshot of claim 1 wherein the handle further includes a plurality of mounting posts corresponding with the plurality of grooves.

5. The slingshot of claim 1, further comprising a handle guard extending forwardly from the handle in a generally arcuate manner from a bottom of a forward face of the handle to a top of a forward face of the handle.

6. The slingshot of claim 1, the handle further comprising a bore formed therethrough for mounting accessories.

7. The slingshot of claim 1, the handle further comprising a top having an elongated recess configured to receive a portion of a retaining clip.

8. The slingshot of claim 7, the handle further comprising a groove formed at a bottom of a forward face thereof.

9. The slingshot of claim 8, further comprising a handle guard extending forwardly from the handle in a generally arcuate manner from the bottom of the forward face of the handle to the top of the forward face of the handle.

10. The slingshot of claim 9, the handle guard further comprising a tongue formed at one end and an aperture and recess formed at another end, wherein the groove at the bottom of the forward face of the handle is configured to receive the tongue formed at the one end and the elongated recess at the top of the handle is configured to receive the another end of the handle guard.

11. The slingshot of claim 10, wherein the another end of the handle guard and the arm brace are secured to the top of the handle by the retaining clip.

12. A handle for a slingshot, the handle comprising:

a plurality of grooves, the grooves spaced along a length of the handle and disposed on a rearward face of the handle, each groove of the plurality of grooves being substantially equal in size and shape to the other grooves of the plurality of grooves, such that each groove is configured to matingly receive a lip of a palm plate to removably secure the palm plate within the groove;

a top having an elongated recess configured to receive a portion of a retaining clip; and a groove formed at a bottom of a forward face thereof.

13. The handle of claim 12, further comprising a bore formed therethrough for mounting accessories.

14. A palm plate for a handle of a slingshot, the palm plate adjustably positionable along a length of the handle of the slingshot to accommodate differently sized gripping areas, the palm plate comprising:

a generally solid, plate-like body with a pair of arms extending therefrom, each arm including an inwardly projecting collar; and a lip disposed between the arms and extending from the body; wherein the collars are configured to matingly and removably engage mounting posts of the handle and the lip is configured to matingly and removably engage grooves of the handle to removably secure the palm plate at a location along the length of the handle.

15. A handle guard for attaching to a forward face of a handle of a slingshot, the handle guard comprising:

a generally arcuate, single, continuous strap of material having a first end and a second end;

a tongue disposed at the first end configured to matingly engage a groove formed on a bottom of the forward face of the handle, the tongue having a width greater than a width of the strap;

a handle guard recess extending inwardly from the second end along a portion of a length of the strap, the handle guard recess formed by a section of reduced strap thickness; and an aperture disposed adjacent to the handle guard recess and spaced from the second end, wherein the second end is configured to be received in an elongated recess formed in a generally flat top surface of the handle, the aperture is configured to receive a retaining clip therethrough, and the handle guard recess is configured to receive a portion of the retaining clip such that the retaining clip lies within the handle guard recess along a length of the strap and the retaining clip extends through the aperture to attach the handle guard to the top surface of the handle.

16. The slingshot of claim 4, the palm plate further comprising a pair of arms extending from the body, the lip being disposed between the arms, each arm including a collar, wherein the collars are configured to matingly engage the mounting posts on the handle to further secure the palm plate at the location along the length of the handle.

* * * * *